US012805559B2

(12) United States Patent
Batista et al.

(10) Patent No.: US 12,805,559 B2
(45) **Date of Patent: *Nov. 24, 2026**

(54) AEROSOL-GENERATING ARTICLE COMPRISING A TUBULAR ELEMENT WITH AT LEAST TWO AIRFLOW CHANNELS

(71) Applicant: Philip Morris Products S.A., Neuchatel (CH)

(72) Inventors: Rui Nuno Rodrigues Alves Batista, Morges (CH); Cheng Peng, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 514 days.

This patent is subject to a terminal disclaimer.

(21) Appl. No.: 18/264,282

(22) PCT Filed: Feb. 10, 2022

(86) PCT No.: PCT/EP2022/053303

§ 371 (c)(1),
(2) Date: Aug. 4, 2023

(87) PCT Pub. No.: WO2022/171768

PCT Pub. Date: Aug. 18, 2022

(65) Prior Publication Data

US 2024/0099359 A1 Mar. 28, 2024

(30) Foreign Application Priority Data

Feb. 10, 2021 (EP) ..... 21156425

(51) Int. Cl.
*A24D 1/20* (2020.01)
*A24D 1/00* (2020.01)
(Continued)

(52) U.S. Cl.
CPC ..... *A24D 1/20* (2020.01); *A24D 1/002* (2013.01); *A24D 1/027* (2013.01); *A24D 3/17* (2020.01); *A24F 40/20* (2020.01); *A24F 40/465* (2020.01)

(58) Field of Classification Search
None
See application file for complete search history.

(56) References Cited

U.S. PATENT DOCUMENTS 6,089,857 A 7/2000 Matsuura et al.
9,894,930 B2 2/2018 Bonici et al.
(Continued)

FOREIGN PATENT DOCUMENTS

CN 107106797 A 8/2017
CN 108142992 A 6/2018
(Continued)

OTHER PUBLICATIONS

Extended European Search Report issued Jan. 4, 2022 in European Patent Application No. 21156425.7, 9 pages.
(Continued)

*Primary Examiner* — Michael H. Wilson
*Assistant Examiner* — Daniel Edward Vakili
(74) *Attorney, Agent, or Firm* — Oblon, McClelland, Maier & Neustadt, L.L.P.

(57) ABSTRACT

An aerosol-generating article having upstream and downstream ends is provided, the article defining a longitudinal direction between the upstream and downstream ends, the article including: an aerosol-forming substrate; a tubular element disposed downstream of the substrate and extending along the longitudinal direction, the tubular element including inner and outer tubes, the outer tube being disposed around the inner tube, an outer airflow channel being longitudinally delimited by the inner and outer tubes, an inner
(Continued)

airflow channel being longitudinally delimited by the inner tube, and the inner airflow channel is configured for substrate aerosol to flow towards the downstream end; a flavour substrate disposed downstream of the substrate; and a permeability control element including a gel composition, the control element being configured to be fluid permeable when a temperature of the control element is equal to or greater than a permeability transition temperature of the control element.

16 Claims, 12 Drawing Sheets

(51) Int. Cl.

| | |
|---|---|
| ***A24D 1/02*** | (2006.01) |
| ***A24D 3/17*** | (2020.01) |
| ***A24F 40/20*** | (2020.01) |
| *A24F 40/465* | (2020.01) |

(56) References Cited

U.S. PATENT DOCUMENTS

| | | | | |
|---|---|---|---|---|
| 10,383,360 | B2 | 8/2019 | Hufnagel et al. | |
| 2012/0255569 | A1* | 10/2012 | Beard | A24D 3/061 131/342 |
| 2017/0340005 | A1 | 11/2017 | Terao | |
| 2021/0153555 | A1 | 5/2021 | Gill | |
| 2021/0315264 | A1 | 10/2021 | Lord et al. | |

FOREIGN PATENT DOCUMENTS

| | | | |
|---|---|---|---|
| CN | 110419773 | A | 11/2019 |
| CN | 110664006 | A | 1/2020 |
| CN | 210538876 | U | 5/2020 |
| EP | 0 146 114 | A1 | 6/1985 |
| JP | 2018-201514 | A | 12/2018 |
| JP | 2019-505195 | A | 2/2019 |
| JP | 2019-50816 | A | 4/2019 |
| JP | 2019-515658 | A | 6/2019 |
| RU | 2 718 896 | C2 | 4/2020 |
| WO | WO 2012/164009 | A2 | 12/2012 |
| WO | WO 2019/197316 | A1 | 10/2019 |
| WO | WO 2019/224068 | A1 | 11/2019 |
| WO | WO 2020/089052 | A1 | 5/2020 |
| WO | WO 2020/098320 | A1 | 5/2020 |
| WO | WO 2020/142004 | A1 | 7/2020 |

OTHER PUBLICATIONS

International Search Report & Written Opinion issued May 27, 2022 in PCT/EP2022/053303 filed on Feb. 10, 2022, 8 pages.

Combined Russian Office Action and Search Report issued on Jul. 1, 2025 in Russian Patent Application No. 2023123328, 7 pages.

Combined Chinese Office Action and Search Report issued Jan. 15, 2026 in Chinese Patent Application No. 202280012971.0 (with English Translation), 21 pages.

Japanese Office Action issued Jan. 26, 2026 in Japanese Patent Application No. 2023-547251 (with unedited computer-generated English Translation), 6 pages.

Final Office Action dated Aug. 28, 2026 issued in related U.S. Appl. No. 18/264,263.

* cited by examiner

AEROSOL-GENERATING ARTICLE COMPRISING A TUBULAR ELEMENT WITH AT LEAST TWO AIRFLOW CHANNELS

The present invention relates to aerosol-generating articles comprising an aerosol-forming substrate for generating an inhalable aerosol when heated.

Aerosol-generating articles in which an aerosol-forming substrate, such as a tobacco containing substrate, is heated rather than combusted are known in the art. An aim of such heated aerosol-generating articles is to reduce potentially harmful by-products produced by the combustion and pyrolytic degradation of tobacco in conventional cigarettes.

In heated aerosol-generating articles, an inhalable aerosol is typically generated by the transfer of heat from a heater to an aerosol-forming substrate. During heating, volatile compounds are released from the aerosol-forming substrate and become entrained in air. For example, the volatile compounds may become entrained in air drawn through, over, around or otherwise within the vicinity of the aerosol-generating article. As the released volatile compounds cool, they condense to form an aerosol. The aerosol may be inhaled by a user. The aerosol may contain aromas, flavours, nicotine and other desired elements.

The heating element may be comprised in an aerosol-generating device. The combination of an aerosol-generating article and an aerosol-generating device may form an aerosol-generating system.

Heated aerosol-generating articles may comprise a flavour substrate in addition to the aerosol-forming substrate. By means of a transfer of heat from a heater to the flavour substrate, volatile compounds are released from the flavour substrate and become entrained in air. As the released volatile compounds cool, they condense to form an aerosol which may contain aromas, flavours, nicotine and other desired elements. The aerosol formed from the flavour substrate may become entrained with the aerosol formed from the aerosol-forming substrate. The resulting blended aerosol may be inhaled by a user.

It would therefore be desirable to provide an aerosol-generating article in which a blended aerosol formed from an aerosol-forming substrate and from a separate flavour substrate is generated in an efficient manner.

An aerosol-generating article may be provided. The aerosol-generating article may have an upstream end and a downstream end, the aerosol-generating article defining a longitudinal direction between the upstream end and the downstream end. The aerosol-generating article may comprise an aerosol-forming substrate. The aerosol-generating article may comprise a tubular element disposed downstream of the aerosol-forming substrate and extending along the longitudinal direction. The tubular element may comprise an inner tube and an outer tube, the outer tube being disposed around the inner tube. An outer airflow channel may be longitudinally delimited by the inner tube and the outer tube. An inner airflow channel may be longitudinally delimited by the inner tube. The at least one inner airflow channel may be adapted for substrate aerosol to flow towards the downstream end. A flavour substrate may be disposed downstream of the aerosol-forming substrate. The aerosol-generating article may comprise at least one permeability control element. The permeability control element may comprise or be the flavour substrate. The at least one permeability control element may be configured to be fluid permeable when the temperature of the at least one permeability control element is equal to or greater than a permeability transition temperature of the at least one permeability control element. The at least one permeability control element may be configured to be substantially fluid impermeable when the temperature of the at least one permeability control element is lower than the permeability transition temperature of the at least one permeability control element. The at least one permeability control element may be disposed within the outer airflow channel. The at least one permeability control element may be configured to prevent a fluid from flowing along the outer airflow channel downstream of the permeability control element when the temperature of the at least one permeability control element is lower than the permeability transition temperature of the at least one permeability control element. The at least one permeability control element may be configured to allow a fluid to flow along the outer airflow channel downstream of the permeability control element when the temperature of the at least one permeability control element is equal to or greater than the permeability transition temperature of the at least one permeability control element. The at least one permeability control element may be configured to prevent a fluid from flowing along the outer airflow channel downstream of the permeability control element when the temperature of the at least one permeability control element is 20 degrees Celsius. The at least one permeability control element may be configured to allow a fluid to flow along the outer airflow channel downstream of the permeability control element when the temperature of the at least one permeability control element 85 degrees Celsius.

An aerosol-generating article may be provided, the aerosol-generating article having an upstream end and a downstream end, the aerosol-generating article defining a longitudinal direction between the upstream end and the downstream end, the aerosol-generating article comprising:

- an aerosol-forming substrate;
- a tubular element disposed downstream of the aerosol-forming substrate and extending along the longitudinal direction, the tubular element comprising an inner tube and an outer tube, the outer tube being disposed around the inner tube, wherein an outer airflow channel is longitudinally delimited by the inner tube and the outer tube, wherein an inner airflow channel is longitudinally delimited by the inner tube, and wherein at least the inner airflow channel is adapted for substrate aerosol to flow towards the downstream end;
- a flavour substrate disposed downstream of the aerosol-forming substrate;
- at least one permeability control element,
  - wherein the at least one permeability control element is configured to be fluid permeable when the temperature of the at least one permeability control element is equal to or greater than a permeability transition temperature of the at least one permeability control element,
  - wherein the at least one permeability control element is configured to be substantially fluid impermeable when the temperature of the at least one permeability control element is lower than the permeability transition temperature of the at least one permeability control element,
  - and wherein the at least one permeability control element is disposed within the outer airflow channel, the at least one permeability control element being configured to prevent a fluid from flowing along the outer airflow channel downstream of the permeability control element when the temperature of the at least one permeability control element is lower than the permeability transition temperature of the at least one permeability control element, and to allow a fluid to flow along the outer airflow channel downstream of the permeability control element when the temperature of the at least one permeability control element is equal to or greater than the permeability transition temperature of the at least one permeability control element.

As used herein, the term "tubular element" is used to denote a generally elongate element defining a lumen or airflow channel along a longitudinal axis thereof. In particular, the term "tubular" will be used in the following with reference to a tubular element having a substantially cylindrical cross-section and defining at least one airflow channel establishing an uninterrupted fluid communication between an upstream end of the tubular element and a downstream end of the tubular element. However, it will be understood that alternative geometries (for example, alternative cross-sectional shapes) of the tubular element may be possible.

As used herein, the term "elongate" means that an element has a length dimension that is greater than its width dimension or its diameter dimension, for example twice or more its width dimension or its diameter dimension.

The term "aerosol-generating article" is used herein to denote an article wherein an aerosol-forming substrate may be heated to produce and deliver inhalable aerosol to a consumer. As used herein, the term "aerosol-forming substrate" relates to a substrate capable of releasing volatile compounds that can form an aerosol. Such volatile compounds may be released by heating the aerosol-forming substrate. An aerosol-forming substrate is typically part of an aerosol-generating article.

The aerosol-forming substrate may comprise nicotine. The nicotine-containing aerosol-forming substrate may be a nicotine salt matrix.

The aerosol-forming substrate may be a liquid. The aerosol-forming substrate may comprise solid components and liquid components. Preferably, the aerosol-forming substrate is a solid.

The aerosol-forming substrate may comprise plant-based material. The aerosol-forming substrate may comprise tobacco. The aerosol-forming substrate may comprise a tobacco-containing material including volatile tobacco flavour compounds which are released from the aerosol-forming substrate upon heating. The aerosol-forming substrate may comprise a non-tobacco material. The aerosol-forming substrate may comprise homogenised plant-based material.

As used herein, the term "aerosol-generating device" refers to a device comprising a heater that interacts with the aerosol-forming substrate or the flavour substrate of the aerosol-generating article to generate an aerosol.

As used herein with reference to the present invention, the term "rod" is used to denote a generally cylindrical element of substantially circular, oval or elliptical cross-section.

As used herein, the term "longitudinal" refers to the direction corresponding to the main longitudinal axis of the aerosol-generating article, which extends between the upstream and downstream ends of the aerosol-generating article. As used herein, the terms "upstream" and "downstream" describe the relative positions of elements, or portions of elements, of the aerosol-generating article in relation to the direction in which the aerosol is transported through the aerosol-generating article during use.

During use, air is drawn through the aerosol-generating article in the longitudinal direction. The term "transverse" refers to the direction that is perpendicular to the longitudinal axis. Any reference to the "cross-section" of the aerosol-generating article or a component of the aerosol-generating article refers to the transverse cross-section unless stated otherwise.

The term "length" denotes the dimension of a component of the aerosol-generating article in the longitudinal direction. For example, it may be used to denote the dimension of the rod or of the elongate tube-like elements in the longitudinal direction.

As used herein, the term "flavour substrate" relates to a substrate, separate from the aerosol-forming substrate, capable of releasing volatile compounds that can form an aerosol. Such volatile compounds may be released by heating the flavour substrate.

As used herein, the "permeability transition temperature" of a material is a temperature at which the permeability of the material changes drastically upon heating or cooling the material. It may be established that, at temperatures below the permeability transition temperature, the material is substantially fluid impermeable and, at temperatures at or above the permeability transition temperature, the material is fluid permeable.

The permeability transition temperature of a material may be the phase transition temperature of the material. When heated to the phase transition temperature, the material may change phase from solid to liquid. When cooled to the phase transition temperature, the material may change phase from liquid to solid.

The use of a flavour substrate to generate an aerosol upon heating may be desirable to generate a uniform and highly consistent flavour aerosol to be entrained with the substrate aerosol generated by the aerosol-forming substrate disposed upstream of the flavour substrate.

Likewise, the provision of an inner airflow channel and an outer airflow channel within the tubular element may enable the existence of at least two independent airflow paths within the tubular element. The inner airflow channel is normally adapted for the substrate aerosol generated upon heating of the aerosol-forming substrate to flow towards the downstream end. The outer airflow path may be used to regulate the overall amount of airflow flowing along the tubular element. In particular, at least one permeability control element may be disposed within the outer airflow channel. The at least one permeability control element may configured to prevent a fluid from flowing along the outer airflow channel downstream of the at least one permeability control element when its temperature is below its permeability transition temperature, and to allow a fluid to flow along the outer airflow channel downstream of the at least one permeability control element when its temperature is equal to or greater than its permeability transition temperature.

Therefore, the provision of the flavour substrate within or downstream of the tubular element may be beneficial in that the amount of airflow the flavour substrate is provided with may be regulated. This may allow for a customisation of the aerosol generated by the flavour substrate. This may also improve the consistency of the aerosol generated by the flavour substrate upon heating.

Furthermore, the variation of the temperature of the at least one permeability control element can be used to provide greater control over the overall resistance to draw (RTD) of the aerosol-generating article. In particular, the at least one permeability control element can advantageously be used to enable potential reductions in RTD due to changes of permeability of the at least one permeability control element during use.

The tubular element preferably defines at least one airflow channel establishing an uninterrupted fluid communication between an upstream location within the tubular element and a downstream location within the tubular element. The tubular element preferably defines at least one airflow channel establishing an uninterrupted fluid communication between an upstream end of the tubular element and a downstream end of the tubular element. The flavour substrate is preferably configured to allow a fluid flowing along the at least one airflow channel to flow downstream of the flavour substrate when the temperature of the flavour material is equal to or greater than a permeability transition temperature of the flavour material. The flavour substrate is preferably configured to prevent a fluid flowing along the at least one airflow channel from flowing downstream of the flavour substrate when the temperature of the flavour material is lower than the permeability transition temperature of the flavour material.

The flavour substrate may not extend across an entire cross section of an airflow channel, in order to allow for airflow to flow towards the downstream end.

Alternatively, the flavour substrate may obstruct an airflow channel. The flavour substrate may extend across the entire cross section of the one or more airflow channels, in order to obstruct airflow towards the downstream end. As such, the flavour substrate may extend across about 100 percent of the cross section of an airflow channel. The flavour substrate may extend across at least about 25 percent of the cross section of an airflow channel. The flavour substrate may extend across at least about 50 percent of the cross section of an airflow channel. The flavour substrate may extend across at least about 75 percent of the cross section of an airflow channel.

For at least the above reasons, the at least one permeability control element may improve the customisation of a user's experience.

The outer airflow channel may also be adapted for the substrate aerosol generated upon heating of the aerosol-forming substrate to flow towards the downstream end.

The at least one permeability control element may be configured to prevent a fluid from flowing along the outer airflow channel downstream of the permeability control element when the temperature of the at least permeability control element is 20 degrees Celsius and to allow a fluid to flow along the outer airflow channel downstream of the permeability control element when the temperature of the at least one permeability control element is 85 degrees Celsius.

A permeability control element which is substantially fluid impermeable at 20 degrees Celsius and fluid permeable at 85 degrees Celsius may be desirable to achieve a regulation of the airflow within the outer airflow channel using an aerosol-generating device.

The permeability transition temperature of the at least one permeability control element may be between 70 degrees Celsius and 80 degrees Celsius.

The flavour substrate may be disposed within the outer airflow channel. This may be advantageous in that the flavour substrate may be configured to regulate airflow within the outer airflow channel. This may also enhance the control of airflow the flavour substrate is provided with.

The flavour substrate may be a permeability control element. The flavour substrate may be the permeability control element. The permeability control element may be the flavour substrate. This may allow for an optimised design of the aerosol-generating article in which the flavour substrate also contributes to the regulation of the airflow within the outer airflow channel. The aerosol-generating article may comprise only one permeability control element. When the aerosol-generating article comprises only one permeability control element, the flavour substrate may be the only permeability control element.

The aerosol-generating article may comprise more than one permeability control element. When the aerosol-generating article comprises more than one permeability control element, the flavour substrate may be one of the more than one permeability control element. When the aerosol-generating article comprises more than one permeability control element, the permeability transition temperature of the more than one permeability control element may be substantially the same temperature. Likewise, when the aerosol-generating article comprises more than one permeability control element, the more than one permeability control element may have different permeability transition temperatures relative to each other.

A permeability control element may be disposed downstream of the flavour substrate. This configuration may be beneficial to allow for a control of the amount of flavour aerosol which is entrained with the substrate aerosol generated upon heating of the aerosol-forming substrate.

The permeability transition temperature of the at least one permeability control element may be a phase transition temperature of the at least one permeability control element. When heated to the phase transition temperature, the at least one permeability control element may change phase from solid to liquid. When cooled to the phase transition temperature, the at least one permeability control element may change phase from liquid to solid.

The changes of permeability between the solid state and the liquid state of the at least one permeability control element may be advantageously relied upon to achieve a regulation of the airflow within the outer airflow channel.

The at least one permeability control element may comprise a gel composition. A gel composition of at least one permeability control element may be in accordance with any gel composition described herein. A gel composition of at least one permeability control element may be in accordance with any gel composition described herein, without nicotine or a flavour agent. A gel composition of at least one permeability control element that is not a flavour substrate may be in accordance with any gel composition described herein, without nicotine or a flavour agent.

The gel composition may be useful to provide the at least one permeability control element with the required changes of permeability as a function of the temperature.

However, other materials different from the gel composition which also present changes of permeability as a function of the temperature may be used.

The gel composition or material may be thermo-reversible.

As used herein, "thermo-reversible" refers to a material, such as a gel composition, whose properties (in particular, the permeability) may be reversed to a former state by heating or cooling the material to the temperature corresponding to such former state. In particular, if the material is at a first temperature below its permeability transition temperature, such that the material has a first permeability at which the material is substantially fluid impermeable, then heated at or above its permeability transition temperature, such that the material reaches a second permeability at which the material is fluid permeable, and finally the material is cooled to the first temperature, the permeability of the material is reversed to substantially the first permeability. Likewise, if the material is at a first temperature at or above its permeability transition temperature, such that the material has a first permeability at which the material is fluid permeable, then cooled below its permeability transition temperature, such that the material reaches a second permeability at which the material is substantially fluid impermeable, and finally the material is heated to the first temperature, the permeability of the material is reversed to substantially the first permeability.

Advantageously, by providing a thermo-reversible material, such as a thermo-reversible gel, an aerosol-generating device may be configured to repeatedly change properties of the aerosol-generating article during use, such as the resistance to draw, the amount of airflow within the article or the amount of aerosol generated upon heating of the flavour substrate. In particular, the properties of the aerosol-generating article may be reversed to their former state.

A spanning element may disposed within the outer airflow channel upstream of the flavour substrate.

The spanning element may be useful to regulate or impede the flow of substrate aerosol into the outer airflow channel.

The spanning element may be a permeability control element.

When the spanning element is a permeability control element, the regulation of the flow of substrate aerosol into the outer airflow channel may advantageously be achieved by varying the permeability of the spanning element.

The flavour substrate may extend longitudinally along the entire outer airflow channel. This may make the flavour substrate more versatile to control the regulation of airflow along the outer airflow channel and to regulate the flow of substrate aerosol into the outer airflow channel.

The aerosol-generating article may comprise an air inlet configured to allow for the intake of outside air into the outer airflow channel.

When the outer airflow channel comprises an air inlet, the outer airflow channel may advantageously be utilised to regulate the flow of outside air into the aerosol-generating article. This may enhance the customisation of the aerosol inhalable by a user.

The air inlet may be disposed downstream of the spanning element.

By disposing the air inlet downstream of the spanning element, the outer airflow channel may be configured to selectively or permanently impede the flow of substrate aerosol into the outer airflow channel. Therefore, the outer airflow channel may be configured to exclusively regulate the intake of outside air into the aerosol-generating article and, when the flavour element is disposed within the outer airflow channel, the flow of flavour aerosol along the outer airflow channel, independently from the flow of substrate aerosol.

When the spanning element is a permeability control element, substrate aerosol may be allowed into the outer airflow channel. This may contribute to improving the blend of flavour aerosol, substrate aerosol and outside air to generate the aerosol inhalable a user.

The flavour substrate may be disposed downstream of the air inlet.

The provision of the flavour substrate downstream of the air inlet comprised in the tubular element may be beneficial to control the amount of airflow the flavour substrate is provided with. This may allow for a customisation of the aerosol generated by the flavour substrate. This may also improve the consistency of the flavour aerosol generated by the flavour substrate upon heating.

The tubular element may be disposed immediately downstream of the aerosol-forming substrate.

This configuration in which no intermediate parts are disposed between the aerosol-forming substrate and the tubular element may be beneficial to ensure that the substrate aerosol generated upon heating of the aerosol-forming substrate is more efficiently entrained with the flavour aerosol generated upon heating of the flavour substrate.

The resistance to draw of the aerosol-generating article when the temperature of the at least one permeability control element is equal to or greater than the permeability transition temperature of the at least one permeability control element may be at least about 10 mm $H_2O$ greater than the resistance to draw of the aerosol-generating article when the temperature of the at least one permeability control element is lower than the permeability transition temperature of the at least one permeability control element.

As discussed above, the permeability of the at least one permeability control element may be varied by cooling or heating the at least one permeability control element to suitable temperatures. In particular, the at least one permeability control element may become fluid permeable when heated to its permeability transition temperature. This may allow for variations in the resistance to draw of the aerosol-generating article which can be easily achieved and determined. A difference of at least about 10 mm $H_2O$ between the resistance to draw of the aerosol-generating article when the temperature of the at least one permeability control element is equal to or greater than its permeability transition temperature with respect to the resistance to draw of the aerosol-generating article when the temperature of the at least one permeability control element is lower than its permeability transition temperature is advantageous in that it may provide a significant change in a user's experience.

More preferably, the resistance to draw of the aerosol-generating article when the temperature of the at least one permeability control element may be equal to or greater than the permeability transition temperature of the at least one permeability control element may be at least about 20 mm $H_2O$ greater than the resistance to draw of the aerosol-generating article when the temperature of the at least one permeability control element is lower than the permeability transition temperature of the at least one permeability control element. Even more preferably, the resistance to draw of the aerosol-generating article when the temperature of the at least one permeability control element may be equal to or greater than the permeability transition temperature of the at least one permeability control element may be at least about 30 mm $H_2O$ greater than the resistance to draw of the aerosol-generating article when the temperature of the at least one permeability control element is lower than the permeability transition temperature of the at least one permeability control element.

The resistance to draw of the aerosol-generating article when the temperature of the at least one permeability control element is lower than the permeability transition temperature of the at least one permeability control element may be greater than about 20 mm $H_2O$, even more preferably greater than about 30 mm $H_2O$, even more preferably greater than about 40 mm $H_2O$, even more preferably greater than about 50 mm $H_2O$, most preferably greater than about 60 mm $H_2O$.

The resistance to draw of the aerosol-generating article when the temperature of the at least one permeability control element is equal to or greater than the permeability transition temperature of the at least one permeability control element may be lower than about 50 mm $H_2O$, even more preferably lower than about 40 mm $H_2O$, even more preferably lower than about 30 mm $H_2O$, even more preferably lower than about 20 mm $H_2O$, most preferably lower than about 10 mm $H_2O$.

The distance between the upstream end of the aerosol-forming substrate and the downstream end of the flavour substrate may be less than about 40 millimetres, preferably less than about 30 millimetres, even more preferably less than 20 millimetres.

A distance between the upstream end of the aerosol-forming substrate and the downstream end of the flavour substrate within such ranges may be beneficial to generate a more consistent aerosol when the substrate aerosol generated upon heating of the aerosol-forming substrate and the flavour aerosol generated upon heating of the flavour substrate blend to form an aerosol inhalable by a user.

The tubular element may have a length between about 3.9 mm and about 8 mm, preferably between about 4.4 mm and 7.8 mm.

The ratio between the length of the tubular element and the length of the aerosol-generating article may be between about 0.2 and about 0.45, more preferably between about 0.25 and 0.35.

A tubular element having such lengths, or such relative lengths compared to the length of the aerosol-generating article, may also improve the blend of substrate aerosol generated upon heating of the aerosol-forming substrate, flavour aerosol generated upon heating of the flavour substrate and outside air drawn into the tubular element through the air inlet.

The aerosol-generating article may comprise a regulating member disposed on the tubular element and movable relative to the tubular element, such that the regulating member is configured to vary the size of the air inlet.

The provision of a regulating member to vary the size of the air inlet may be advantageous to control the amount of airflow within the aerosol-generating article during use. The regulating member may be used in conjunction with the at least one permeability control element to regulate the amount of airflow within the aerosol-generating article during use. This may allow for more versatility in the regulation of the airflow within the aerosol-generating article.

The regulating member and the tubular element may be linearly moveable relative to one another. The regulating member and the tubular element may be configured to rotate relative to one another. The regulating member and the tubular element may be configured rotate and move linearly relative to one another, for example, by means of a screw thread.

The flavour substrate may comprise a flavour material, such as a gel composition.

The use of a flavour substrate comprising a flavour material to generate an aerosol upon heating may be desirable because it provides a uniform substrate that can generate a highly consistent aerosol to be entrained with the aerosol generated by the aerosol-forming substrate disposed upstream of the flavour substrate.

When the flavour substrate comprises a flavour material, the flavour material may be configured to be fluid permeable when the temperature of the flavour material is equal to or greater than a permeability transition temperature of the flavour material, and the flavour material may be configured to be substantially fluid impermeable when the temperature of the flavour material is lower than the permeability transition temperature of the flavour material.

The permeability transition temperature may be a phase transition temperature, such that when the flavour substrate is heated to the phase transition temperature of the flavour material, the flavour material may change phase from solid gel to liquid, and when the flavour substrate is cooled to the phase transition temperature of the gel composition, the flavour material may change phase from liquid to solid gel.

When the flavour substrate comprises such flavour material of varying permeability, the properties of the gel composition may be beneficial to provide greater control over the overall resistance to draw (RTD) of the aerosol-generating article. In particular, the flavour substrate can advantageously be used to enable potential reductions in RTD due to changes of permeability of the gel composition during use.

Likewise, the flavour substrate can be used to vary the airflow within the aerosol-generating article relying on the changes of permeability of the flavour material during use. This may be particularly useful when the flavour substrate is disposed within the outer airflow channel.

The flavour material may be configured to be fluid permeable at 85 degrees Celsius. The flavour material may be configured to be substantially fluid impermeable at 20 degrees Celsius.

The flavour material may comprise a gel composition. A gel composition may be advantageous in that it may give rise to a particularly uniform and highly consistent flavour aerosol to be entrained with the substrate aerosol generated by the aerosol-forming substrate disposed upstream of the flavour substrate.

The permeability transition temperature of a material may be the phase transition temperature of the material. When heated to the phase transition temperature, the material may change phase from solid to liquid. When cooled to the phase transition temperature, the material may change phase from liquid to solid.

When the flavour substrate comprises a gel composition, the permeability transition temperature of the gel composition may be a phase transition temperature of the gel composition, such that when the flavour substrate is heated to the phase transition temperature, the gel composition may change phase from solid gel to liquid, and when the flavour substrate is cooled to the phase transition temperature, the gel composition may change phase from liquid to solid gel.

The gel composition may be configured to be fluid permeable at 85 degrees Celsius. The gel composition may be configured to be substantially fluid impermeable at 20 degrees Celsius.

The permeability transition temperature of the flavour material, such as a gel composition, may be between 70 degrees Celsius and 80 degrees Celsius.

A permeability transition temperature between 70 degrees Celsius and 80 degrees Celsius may be advantageous in that this temperature may be easily reached by heating the flavour substrate with an aerosol-generating device. This may facilitate the change of properties of the aerosol-generating article during use.

The flavour material may be thermo-reversible. The gel composition may be thermo-reversible.

The flavour material, such as a gel composition, may preferably include an alkaloid compound selected from the group consisting of nicotine, anatabine, and combinations thereof.

The flavour material, such as a gel composition, may include nicotine. The amount of nicotine may be nicotine between about 0.1% and about 4%, preferably between about 0.1% and about 2%.

The term "nicotine" refers to nicotine and nicotine derivatives such as free-base nicotine, nicotine salts and the like.

The flavour material, such as a gel composition, may comprise a flavouring agent. The flavouring agent may comprise menthol, coffee derivate flavourings containing, caffeine, guarana, taurine, glucuronolactone or any combination thereof. The flavouring agent may comprise menthol extract. The menthol extract may have a minimum of about 55 percent menthol ($C_{10}H_{20}O$). The flavouring agent may comprise vanilla extract. The vanilla extract may have a minimum of about 20 percent vanillin ($C_8H_8O_3$). The flavour material, such as a gel composition, may comprise about 0.2% to 4% of flavouring agent, preferably about 0.4 to 2%.

The flavour material, such as a gel composition, may include glycerine. The amount of glycerine may be between about 50% and about 75%, preferably between about 50% and about 65%.

The flavour material, such as a gel composition, may include hydroxypropylmethyl cellulose (HPMC). The amount of HPMC may be between about 15% and about 35%, preferably between about 18% and about 32%, more preferably between about 20% and about 30%, more preferably between about 21% and about 27%.

The flavour material, such as a gel composition, may include agar. The amount of agar may be between about 3% and about 10%, preferably between about 4% and about 7%.

The flavour material, such as a gel composition, may include fibres. The amount of fibres may be between about 0.1% and about 12%, preferably between about 0.1% and 7%. The fibres may comprise cellulose fibres. The fibres may have a length of at least about 8 micrometres. The fibres may have a length less than about 15 micrometres. The fibres may have a length between about 8 micrometres and about 15 micrometres.

The flavour material, such as a gel composition, may include Low Methoxyl (E440i) pectin. The amount of Low Methoxyl (E440i) pectin may be between about 0.1% and about 9%, preferably between about 0.1% and 7%.

The flavour material, such as a gel composition, may include lactic acid. The amount of lactic acid may be between about 1.7% and about 3.1%, preferably between about 2.1% and about 2.9%.

The flavour material, such as a gel composition, may include calactate (calcium lactate). The amount of calactate may be between about 0.1% and about 7%, preferably between about 0.1% and about 3%.

The above amounts are given in percentage by weight. The amounts in the present disclosure are preferably given in percentage by weight.

The term "cannabinoid compound" refers to any one of a class of naturally occurring compounds that are found in parts of the cannabis plant—namely the species *Cannabis sativa, Cannabis indica*, and *Cannabis ruderalis*. Cannabinoid compounds are especially concentrated in the female flower heads. Cannabinoid compounds naturally occurring in the cannabis plant include cannabidiol (CBD) and tetrahydrocannabinol (THC). In this disclosure, the term "cannabinoid compounds" is used to describe both naturally derived cannabinoid compounds and synthetically manufactured cannabinoid compounds.

The flavour material, such as a gel composition, may include a cannabinoid compound selected from the group consisting of cannabidiol (CBD), tetrahydrocannabinol (THC), tetrahydrocannabinolic acid (THCA), cannabidiolic acid (CBDA), cannabinol (CBN), cannabigerol (CBG), cannabichromene (CBC), cannabicyclol (CBL), cannabivarin (CBV), tetrahydrocannabivarin (THCV), cannabidivarin (CBDV), cannabichromevarin (CBCV), cannabigerovarin (CBGV), cannabigerol monomethyl ether (CBGM), cannabielsoin (CBE), cannabicitran (CBT), and combinations thereof.

The flavour material may comprise hydroxypropylmethyl cellulose. The flavour material may have a hydroxypropylmethyl cellulose content of greater than about 0.5 percent by weight. Advantageously, the inventors have found that hydroxypropylmethyl cellulose may be an effective binder for a flavour material.

The flavour material may have a hydroxypropylmethyl cellulose content of greater than about 1 percent by weight. The flavour material may have a hydroxypropylmethyl cellulose content of greater than about 5 percent by weight. The flavour material may have a hydroxypropylmethyl cellulose content of greater than about 10 percent by weight. The flavour material may have a hydroxypropylmethyl cellulose content of greater than about 15 percent by weight. The flavour material may have a hydroxypropylmethyl cellulose content of greater than about 20 percent by weight.

The flavour material may have a hydroxypropylmethyl cellulose content of less than about 50 percent by weight. The flavour material may have a hydroxypropylmethyl cellulose content of less than about 45 percent by weight. The flavour material may have a hydroxypropylmethyl cellulose content of less than about 40 percent by weight. The flavour material may have a hydroxypropylmethyl cellulose content of less than about 35 percent by weight. The flavour material may have a hydroxypropylmethyl cellulose content of less than about 30 percent by weight. The flavour material may have a hydroxypropylmethyl cellulose content of less than about 25 percent by weight. The flavour material may have a hydroxypropylmethyl cellulose content of less than about 20 percent by weight.

The flavour material may have a hydroxypropylmethyl cellulose content of between about 0.5 percent by weight and about 50 percent by weight. The flavour material may have a hydroxypropylmethyl cellulose content of between about 0.5 percent by weight and about 45 percent by weight. The flavour material may have a hydroxypropylmethyl cellulose content of between about 0.5 percent by weight and about 40 percent by weight. The flavour material may have a hydroxypropylmethyl cellulose content of between about 0.5 percent by weight and about 35 percent by weight. The flavour material may have a hydroxypropylmethyl cellulose content of between about 0.5 percent by weight and about 30 percent by weight. The flavour material may have a hydroxypropylmethyl cellulose content of between about 0.5 percent by weight and about 25 percent by weight. The flavour material may have a hydroxypropylmethyl cellulose content of between about 0.5 percent by weight and about 20 percent by weight.

The flavour material may have a hydroxypropylmethyl cellulose content of between about 0.5 percent by weight and about 40 percent by weight. The flavour material may have a hydroxypropylmethyl cellulose content of between about 1 percent by weight and about 40 percent by weight. The flavour material may have a hydroxypropylmethyl cellulose content of between about 5 percent by weight and about 40 percent by weight. The flavour material may have a hydroxypropylmethyl cellulose content of between about 10 percent by weight and about 40 percent by weight. The flavour material may have a hydroxypropylmethyl cellulose content of between about 15 percent by weight and about 40 percent by weight. The flavour material may have a hydroxypropylmethyl cellulose content of between about 20 percent by weight and about 40 percent by weight. The flavour material may have a hydroxypropylmethyl cellulose content of between about 25 percent by weight and about 40 percent by weight.

The flavour material may have a hydroxypropylmethyl cellulose content of between about 0.5 percent by weight and about 45 percent by weight. The flavour material may have a hydroxypropylmethyl cellulose content of between about 1 percent by weight and about 45 percent by weight. The flavour material may have a hydroxypropylmethyl cellulose content of between about 1 percent by weight and about 40 percent by weight. The flavour material may have a hydroxypropylmethyl cellulose content of between about 5 percent by weight and about 40 percent by weight. The flavour material may have a hydroxypropylmethyl cellulose content of between about 5 percent by weight and about 35 percent by weight. The flavour material may have a hydroxypropylmethyl cellulose content of between about 10 percent by weight and about 35 percent by weight. The flavour material may have a hydroxypropylmethyl cellulose content of between about 10 percent by weight and about 30 percent by weight. The flavour material may have a hydroxypropylmethyl cellulose content of between about 15 percent by weight and about 30 percent by weight. The flavour material may have a hydroxypropylmethyl cellulose content of between about 15 percent by weight and about 25 percent by weight. The flavour material may have a hydroxypropylmethyl cellulose content of between about 20 percent by weight and about 25 percent by weight.

The flavour material may have a cellulose based strengthening agent content of greater than about 0.5 percent by weight. The flavour material may have a cellulose based strengthening agent content of greater than about 1 percent by weight. The flavour material may have a cellulose based strengthening agent content of greater than about 5 percent by weight. The flavour material may have a cellulose based strengthening agent content of greater than about 10 percent by weight. The flavour material may have a cellulose based strengthening agent content of greater than about 15 percent by weight. The flavour material may have a cellulose based strengthening agent content of greater than about 20 percent by weight.

The flavour material may have a cellulose based strengthening agent content of less than about 50 percent by weight. The flavour material may have a cellulose based strengthening agent content of less than about 45 percent by weight. The flavour material may have a cellulose based strengthening agent content of less than about 40 percent by weight. The flavour material may have a cellulose based strengthening agent content of less than about 35 percent by weight. The flavour material may have a cellulose based strengthening agent content of less than about 30 percent by weight. The flavour material may have a cellulose based strengthening agent content of less than about 25 percent by weight. The flavour material may have a cellulose based strengthening agent content of less than about 20 percent by weight. The flavour material may have a cellulose based strengthening agent content of less than about 15 percent by weight.

The flavour material may have a cellulose based strengthening agent content of between about 0.5 percent by weight and about 50 percent by weight. The flavour material may have a cellulose based strengthening agent content of between about 0.5 percent by weight and about 45 percent by weight. The flavour material may have a cellulose based strengthening agent content of between about 0.5 percent by weight and about 40 percent by weight. The flavour material may have a cellulose based strengthening agent content of between about 0.5 percent by weight and about 35 percent by weight. The flavour material may have a cellulose based strengthening agent content of between about 0.5 percent by weight and about 30 percent by weight. The flavour material may have a cellulose based strengthening agent content of between about 0.5 percent by weight and about 25 percent by weight. The flavour material may have a cellulose based strengthening agent content of between about 0.5 percent by weight and about 20 percent by weight. The flavour material may have a cellulose based strengthening agent content of between about 0.5 percent by weight and about 15 percent by weight. The flavour material may have a cellulose based strengthening agent content of between about 0.5 percent by weight and about 10 percent by weight. The flavour material may have a cellulose based strengthening agent content of between about 0.5 percent by weight and about 5 percent by weight.

The flavour material may have a cellulose based strengthening agent content of between about 1 percent by weight and about 40 percent by weight. The flavour material may have a cellulose based strengthening agent content of between about 5 percent by weight and about 40 percent by weight. The flavour material may have a cellulose based strengthening agent content of between about 10 percent by weight and about 40 percent by weight. The flavour material may have a cellulose based strengthening agent content of between about 15 percent by weight and about 40 percent by weight. The flavour material may have a cellulose based strengthening agent content of between about 20 percent by weight and about 40 percent by weight. The flavour material may have a cellulose based strengthening agent content of between about 25 percent by weight and about 40 percent by weight. The flavour material may have a cellulose based strengthening agent content of between about 30 percent by weight and about 40 percent by weight. The flavour material may have a cellulose based strengthening agent content of between about 35 percent by weight and about 40 percent by weight.

The flavour material may have a cellulose based strengthening agent content of between about 1 percent by weight and about 35 percent by weight. The flavour material may have a cellulose based strengthening agent content of between about 5 percent by weight and about 35 percent by weight. The flavour material may have a cellulose based strengthening agent content of between about 5 percent by weight and about 30 percent by weight. The flavour material may have a cellulose based strengthening agent content of between about 10 percent by weight and about 30 percent by weight. The flavour material may have a cellulose based strengthening agent content of between about 10 percent by weight and about 25 percent by weight. The flavour material may have a cellulose based strengthening agent content of between about 15 percent by weight and about 25 percent by weight. The flavour material may have a cellulose based strengthening agent content of between about 15 percent by weight and about 20 percent by weight.

The one or more cellulose based strengthening agents may comprise cellulose fibres. Advantageously, the present inventors have found that cellulose fibres may be a cellulose based strengthening agent that is particularly effective at increasing the tensile strength of a flavour material.

The flavour material may have a cellulose fibres content of greater than about 0.5 percent by weight. The flavour material may have a cellulose fibres content of greater than about 1 percent by weight. The flavour material may have a cellulose fibres content of greater than about 5 percent by weight. The flavour material may have a cellulose fibres content of greater than about 10 percent by weight. The flavour material may have a cellulose fibres content of greater than about 15 percent by weight. The flavour material may have a cellulose fibres content of greater than about 20 percent by weight.

The flavour material may have a cellulose fibres content of less than about 50 percent by weight. The flavour material may have a cellulose fibres content of less than about 45 percent by weight. The flavour material may have a cellulose fibres content of less than about 40 percent by weight. The flavour material may have a cellulose fibres content of less than about 35 percent by weight. The flavour material may have a cellulose fibres content of less than about 30 percent by weight. The flavour material may have a cellulose fibres content of less than about 25 percent by weight. The flavour material may have a cellulose fibres content of less than about 20 percent by weight. The flavour material may have a cellulose fibres content of less than about 15 percent by weight.

The flavour material may have a cellulose fibres content of between about 0.5 percent by weight and about 50 percent by weight. The flavour material may have a cellulose fibres content of between about 0.5 percent by weight and about 45 percent by weight. The flavour material may have a cellulose fibres content of between about 0.5 percent by weight and about 40 percent by weight. The flavour material may have a cellulose fibres content of between about 0.5 percent by weight and about 35 percent by weight. The flavour material may have a cellulose fibres content of between about 0.5 percent by weight and about 30 percent by weight. The flavour material may have a cellulose fibres content of between about 0.5 percent by weight and about 25 percent by weight. The flavour material may have a cellulose fibres content of between about 0.5 percent by weight and about 20 percent by weight. The flavour material may have a cellulose fibres content of between about 0.5 percent by weight and about 15 percent by weight. The flavour material may have a cellulose fibres content of between about 0.5 percent by weight and about 10 percent by weight. The flavour material may have a cellulose fibres content of between about 0.5 percent by weight and about 5 percent by weight.

The flavour material may have a cellulose fibres content of between about 1 percent by weight and about 40 percent by weight. The flavour material may have a cellulose fibres content of between about 5 percent by weight and about 40 percent by weight. The flavour material may have a cellulose fibres content of between about 10 percent by weight and about 40 percent by weight. The flavour material may have a cellulose fibres content of between about 15 percent by weight and about 40 percent by weight. The flavour material may have a cellulose fibres content of between about 20 percent by weight and about 40 percent by weight. The flavour material may have a cellulose fibres content of between about 25 percent by weight and about 40 percent by weight. The flavour material may have a cellulose fibres content of between about 30 percent by weight and about 40 percent by weight. The flavour material may have a cellulose fibres content of between about 35 percent by weight and about 40 percent by weight.

The flavour material may have a cellulose fibres content of between about 1 percent by weight and about 35 percent by weight. The flavour material may have a cellulose fibres content of between about 5 percent by weight and about 35 percent by weight. The flavour material may have a cellulose fibres content of between about 5 percent by weight and about 30 percent by weight. The flavour material may have a cellulose fibres content of between about 10 percent by weight and about 30 percent by weight. The flavour material may have a cellulose fibres content of between about 10 percent by weight and about 25 percent by weight. The flavour material may have a cellulose fibres content of between about 15 percent by weight and about 25 percent by weight. The flavour material may have a cellulose fibres content of between about 15 percent by weight and about 20 percent by weight.

The one or more cellulose based strengthening agents may comprise microcrystalline cellulose. Advantageously, the present inventors have found that microcrystalline cellulose may be a cellulose based strengthening agent that is particularly effective at increasing the tensile strength of a flavour material.

The flavour material may have a microcrystalline cellulose content of greater than about 0.5 percent by weight. The flavour material may have a microcrystalline cellulose content of greater than about 1 percent by weight. The flavour material may have a microcrystalline cellulose content of greater than about 5 percent by weight. The flavour material may have a microcrystalline cellulose content of greater than about 10 percent by weight. The flavour material may have a microcrystalline cellulose content of greater than about 15 percent by weight. The flavour material may have a microcrystalline cellulose content of greater than about 20 percent by weight.

The flavour material may have a microcrystalline cellulose content of less than about 50 percent by weight. The flavour material may have a microcrystalline cellulose content of less than about 45 percent by weight. The flavour material may have a microcrystalline cellulose content of less than about 40 percent by weight. The flavour material may have a microcrystalline cellulose content of less than about 35 percent by weight. The flavour material may have a microcrystalline cellulose content of less than about 30 percent by weight. The flavour material may have a microcrystalline cellulose content of less than about 25 percent by weight. The flavour material may have a microcrystalline cellulose content of less than about 20 percent by weight. The flavour material may have a microcrystalline cellulose content of less than about 15 percent by weight.

The flavour material may have a microcrystalline cellulose content of between about 0.5 percent by weight and about 50 percent by weight. The flavour material may have a microcrystalline cellulose content of between about 0.5 percent by weight and about 45 percent by weight. The flavour material may have a microcrystalline cellulose content of between about 0.5 percent by weight and about 40 percent by weight. The flavour material may have a microcrystalline cellulose content of between about 0.5 percent by weight and about 35 percent by weight. The flavour material may have a microcrystalline cellulose content of between about 0.5 percent by weight and about 30 percent by weight. The flavour material may have a microcrystalline cellulose content of between about 0.5 percent by weight and about 25 percent by weight. The flavour material may have a microcrystalline cellulose content of between about 0.5 percent by weight and about 20 percent by weight. The flavour material may have a microcrystalline cellulose content of between about 0.5 percent by weight and about 15 percent by weight. The flavour material may have a microcrystalline cellulose content of between about 0.5 percent by weight and about 10 percent by weight. The flavour material may have a microcrystalline cellulose content of between about 0.5 percent by weight and about 5 percent by weight.

The flavour material may have a microcrystalline cellulose content of between about 1 percent by weight and about 40 percent by weight. The flavour material may have a microcrystalline cellulose content of between about 5 percent by weight and about 40 percent by weight. The flavour material may have a microcrystalline cellulose content of between about 10 percent by weight and about 40 percent by weight. The flavour material may have a microcrystalline cellulose content of between about 15 percent by weight and about 40 percent by weight. The flavour material may have a microcrystalline cellulose content of between about 20 percent by weight and about 40 percent by weight. The flavour material may have a microcrystalline cellulose content of between about 25 percent by weight and about 40 percent by weight. The flavour material may have a microcrystalline cellulose content of between about 30 percent by weight and about 40 percent by weight. The flavour material may have a microcrystalline cellulose content of between about 35 percent by weight and about 40 percent by weight.

The flavour material may have a microcrystalline cellulose content of between about 1 percent by weight and about 35 percent by weight. The flavour material may have a microcrystalline cellulose content of between about 5 percent by weight and about 35 percent by weight. The flavour material may have a microcrystalline cellulose content of between about 5 percent by weight and about 30 percent by weight. The flavour material may have a microcrystalline cellulose content of between about 10 percent by weight and about 30 percent by weight. The flavour material may have a microcrystalline cellulose content of between about 10 percent by weight and about 25 percent by weight. The flavour material may have a microcrystalline cellulose content of between about 15 percent by weight and about 25 percent by weight. The flavour material may have a microcrystalline cellulose content of between about 15 percent by weight and about 20 percent by weight.

The one or more cellulose based strengthening agents may comprise cellulose powder. Advantageously, the present inventors have found that cellulose powder may be a cellulose based strengthening agent that is particularly effective at increasing the tensile strength of a flavour material.

The flavour material may have a cellulose powder content of greater than about 0.5 percent by weight. The flavour material may have a cellulose powder content of greater than about 1 percent by weight. The flavour material may have a cellulose powder content of greater than about 5 percent by weight. The flavour material may have a cellulose powder content of greater than about 10 percent by weight. The flavour material may have a cellulose powder content of greater than about 15 percent by weight. The flavour material may have a cellulose powder content of greater than about 20 percent by weight.

The flavour material may have a cellulose powder content of less than about 50 percent by weight. The flavour material may have a cellulose powder content of less than about 45 percent by weight. The flavour material may have a cellulose powder content of less than about 40 percent by weight. The flavour material may have a cellulose powder content of less than about 35 percent by weight. The flavour material may have a cellulose powder content of less than about 30 percent by weight. The flavour material may have a cellulose powder content of less than about 25 percent by weight. The flavour material may have a cellulose powder content of less than about 20 percent by weight. The flavour material may have a cellulose powder content of less than about 15 percent by weight.

The flavour material may have a cellulose powder content of between about 0.5 percent by weight and about 50 percent by weight. The flavour material may have a cellulose powder content of between about 0.5 percent by weight and about 45 percent by weight. The flavour material may have a cellulose powder content of between about 0.5 percent by weight and about 40 percent by weight. The flavour material may have a cellulose powder content of between about 0.5 percent by weight and about 35 percent by weight. The flavour material may have a cellulose powder content of between about 0.5 percent by weight and about 30 percent by weight. The flavour material may have a cellulose powder content of between about 0.5 percent by weight and about 25 percent by weight. The flavour material may have a cellulose powder content of between about 0.5 percent by weight and about 20 percent by weight. The flavour material may have a cellulose powder content of between about 0.5 percent by weight and about 15 percent by weight. The flavour material may have a cellulose powder content of between about 0.5 percent by weight and about 10 percent by weight. The flavour material may have a cellulose powder content of between about 0.5 percent by weight and about 5 percent by weight.

The flavour material may have a cellulose powder content of between about 1 percent by weight and about 40 percent by weight. The flavour material may have a cellulose powder content of between about 5 percent by weight and about 40 percent by weight. The flavour material may have a cellulose powder content of between about 10 percent by weight and about 40 percent by weight. The flavour material may have a cellulose powder content of between about 15 percent by weight and about 40 percent by weight. The flavour material may have a cellulose powder content of between about 20 percent by weight and about 40 percent by weight. The flavour material may have a cellulose powder content of between about 25 percent by weight and about 40 percent by weight. The flavour material may have a cellulose powder content of between about 30 percent by weight and about 40 percent by weight. The flavour material may have a cellulose powder content of between about 35 percent by weight and about 40 percent by weight.

The flavour material may have a cellulose powder content of between about 1 percent by weight and about 35 percent by weight. The flavour material may have a cellulose powder content of between about 5 percent by weight and about 35 percent by weight. The flavour material may have a cellulose powder content of between about 5 percent by weight and about 30 percent by weight. The flavour material may have a cellulose powder content of between about 10 percent by weight and about 30 percent by weight. The flavour material may have a cellulose powder content of between about 10 percent by weight and about 25 percent by weight. The flavour material may have a cellulose powder content of between about 15 percent by weight and about 25 percent by weight. The flavour material may have a cellulose powder content of between about 15 percent by weight and about 20 percent by weight.

The flavour material may comprise a carboxymethyl cellulose. Advantageously, using a carboxymethyl cellulose may help to reduce crusting of the flavour material when used in an aerosol-generating article. In some examples, use of a carboxymethyl cellulose eliminates crusting. As used herein, "crusting" is construed as the formation of a solid layer on a component of the aerosol-generating article. The inventors have found that crusting may occur because a component of the flavour material may melt and then re-solidify around a component of the aerosol-generating article. Crusting can be a particular problem when a flavour material is used with an aerosol-generating device that contains a susceptor. If a crust is formed on the susceptor then the crusted susceptor becomes less effective at heating the flavour material, which may lead to reduced delivery of nicotine to a user and/or reduce formation of aerosol from the flavour material.

The carboxymethyl cellulose may comprise sodium carboxymethyl cellulose. Advantageously, the inventors have found that sodium carboxymethyl cellulose is a carboxymethyl cellulose that may be particularly effective at preventing the above mentioned problem of crusting.

The flavour material may have a carboxymethyl cellulose content of greater than about 0.5 percent by weight. The flavour material may have a carboxymethyl cellulose content of greater than about 1 percent by weight. The flavour material may have a carboxymethyl cellulose content of greater than about 5 percent by weight. The flavour material may have a carboxymethyl cellulose content of greater than about 10 percent by weight.

The flavour material may have a carboxymethyl cellulose content of less than about 20 percent by weight. The flavour material may have a carboxymethyl cellulose content of less than about 15 percent by weight. The flavour material may have a carboxymethyl cellulose content of less than about 10 percent by weight. The flavour material may have a carboxymethyl cellulose content of less than about 8 percent by weight. The flavour material may have a carboxymethyl cellulose content of less than about 5 percent by weight.

The flavour material may have a carboxymethyl cellulose content of between about 0.5 percent by weight and about 20 percent by weight. The flavour material may have a carboxymethyl cellulose content of between about 0.5 percent by weight and about 15 percent by weight. The flavour material may have a carboxymethyl cellulose content of between about 0.5 percent by weight and about 10 percent by weight. The flavour material may have a carboxymethyl cellulose content of between about 0.5 percent by weight and about 8 percent by weight. The flavour material may have a carboxymethyl cellulose content of between about 0.5 percent by weight and about 5 percent by weight.

The flavour material may have a carboxymethyl cellulose content of between about 1 percent by weight and about 20 percent by weight. The flavour material may have a carboxymethyl cellulose content of between about 5 percent by weight and about 20 percent by weight. The flavour material may have a carboxymethyl cellulose content of between about 8 percent by weight and about 20 percent by weight. The flavour material may have a carboxymethyl cellulose content of between about 10 percent by weight and about 20 percent by weight. The flavour material may have a carboxymethyl cellulose content of between about 15 percent by weight and about 20 percent by weight.

The flavour material may have a carboxymethyl cellulose content of between about 1 percent by weight and about 15 percent by weight. The flavour material may have a carboxymethyl cellulose content of between about 1 percent by weight and about 10 percent by weight. The flavour material may have a carboxymethyl cellulose content of between about 5 percent by weight and about 10 percent by weight. The flavour material may have a carboxymethyl cellulose content of between about 5 percent by weight and about 8 percent by weight.

The flavour material, such as a gel composition, may have an homogeneous distribution. Likewise, the flavour material, such as a gel composition, may distribute in a variable manner within the flavour substrate.

The flavour substrate may comprise an external layer. The external layer may be useful to give the flavour substrate the required shape to be disposed within the aerosol-generating article.

The external layer may be made of the same material, such as the flavour material or the gel composition, as the remaining part of the flavour substrate.

When the flavour substrate comprises an external layer, the flavour substrate may be manufactured by first depositing a core comprising the remaining part of the flavour substrate and then depositing a layer on the core to form the external layer. This may allow for an efficient manner of providing a flavour substrate to manufacture an aerosol-generating article. The core and the external layer may advantageously be manufactured by extrusion. The external layer may not comprise a flavour agent. The flavour material, such as a gel composition, may be configured to be in solid state within a range of temperatures which covers standard environmental temperatures for use of the aerosol-generating article. A suitable range of temperatures may be from minus 20 degrees Celsius to 70 degrees Celsius.

When the flavour material, such as a gel composition, is in solid state, it may be configured to have a sufficient resistance to deformation in order to provide the flavour substrate with the mechanical stability for its handling during manufacturing, transportation and use of the aerosol-generating article. The resistance to deformation strength of the flavour substrate may be between about 0.5 kgf to about 3 kgf, preferably between about 1.3 kgf to about 2.7 kgf, more preferably between about 1.9 kgf to about 2.5 kgf.

The resistance to deformation strength of the flavour material, such as a gel composition, may be tuned as required by adjusting the composition of the flavour material. For example, adjusting the amount of low methoxyl (LM) pectin within the flavour material may affect the resistance to deformation strength of the flavour material. The amount of low methoxyl (LM) pectin may be between about 0.5 percent and about 5 percent, preferably between about 1 percent and about 3 percent.

Advantageously, a gel composition may be solid at room temperature. "Solid" in this context means that the gel has a stable size and shape and does not flow. Room temperature in this context means about 25 degrees Celsius. A gel may be defined as a substantially dilute cross-linked system, which exhibits no flow when in the steady-state. By weight, gels may be mostly liquid, yet they behave like solids due to a three-dimensional cross-linked network within the liquid. It is the crosslinking within the fluid that gives a gel its structure (hardness). In this way gels may be a dispersion of molecules of a liquid within a solid in which liquid particles are dispersed in the solid medium.

The gel composition may have a viscosity of about 1,000,000 to about 1 Pascal per second, preferably 100,000 to 10 Pascal per second, more preferably 10,000 to 1,000 Pascal per second, or 1,000 to 100 Pascal per second, or 500 to 200 Pascal per second to give the desired viscosity. Viscosity of the gel composition can be measured by taking the viscosity of a sample using an Anton Paar MCR 302 rheometer using a parallel plate PP25 with a P-PTD200+H-PTD200 measuring cell at 25° C. at a shear rate of 1 $s^{-1}$.

The gel composition's mass may not change by more than about 20%, or may not change by more than about 15%, or may not change by more than about 10%, when exposed to a variety of environmental storage conditions. The composition may have an exterior shape with an exposed surface area that does not change by more than about 10%, or does not change by more than about 5%, or does not change by more than about 1%, when exposed to a variety of environmental conditions.

The gel composition may have a mass and the mass does not change by more than about 20%, or does not change by more than about 15%, or does not change by more than about 10%, when exposed to a relative humidity in a range from about 10% to about 60% at 24 degrees Celsius and one atmosphere, or typical storage conditions.

The gel composition may have an exterior shape with an exposed surface area that does not change by more than about 10%, or does not change by more than about 5%, or does not change by more than about 1%, when exposed to a relative humidity in a range from about 10% to about 60% at 24 degrees Celsius and one atmosphere.

The gel composition may have an exposed surface area value (in m 2) and a mass value (in kg), the mass value to exposed surface area value is in a range from about 0.05:1 to about 1:1, or from about 0.1:1 to about 1:1, or from about 0.5:1 to about 1:0.1, or from about 0.5:1 to about 1:0.5.

Advantageously, the gel composition may provide a predictable composition form upon storage or transit from manufacture to the consumer. The gel composition may substantially maintain its shape. The gel composition may substantially do not release a liquid phase upon storage or transit from manufacture to the consumer. of 8 The aerosol-generating article may comprise a filter disposed downstream of the tubular element in the longitudinal direction.

A gel composition of any permeability control element, such as a flavour substrate or a spanning element, may comprise at least glycerin. A gel composition of any permeability control element, such as a flavour substrate or a spanning element, may comprise at least HPMC. A gel composition of any permeability control element, such as a flavour substrate or a spanning element, may comprise at least agar. A gel composition of any permeability control element, such as a flavour substrate or a spanning element, may comprise at least lactic acid.

A gel composition of any permeability control element, such as a flavour substrate or a spanning element, may at least comprise glycerin and HPMC.

A gel composition of any permeability control element, such as a flavour substrate or a spanning element, may at least comprise glycerin, HPMC and agar.

A gel composition of any permeability control element, such as a flavour substrate or a spanning element, may at least comprise glycerin, HPMC, agar and lactic acid.

The gel composition may have a glycerin content of about 52 percent by weight. The gel composition may have a hydroxypropylmethyl cellulose content of about 21.5 percent by weight. The gel composition may have a nicotine content of about 1.5 percent by weight. The gel composition may have an agar content of about 7.6 percent by weight. The gel composition may have a fibers content of about 9 percent by weight. The fibers may be cellulose fibers with lengths of about 8 to about 15 micrometres. The gel composition may have a low methoxyl pectin (E440i) content of about 4 percent by weight. The gel composition may have a lactic acid content of about 2.3 percent by weight. The gel composition may have a Ca-lactate content of about 2.1 percent by weight.

The gel composition may have a glycerin content of about 53 percent by weight. The gel composition may have a hydroxypropylmethyl cellulose content of about 21 percent by weight. The gel composition may have a nicotine content of about 1.1 percent by weight. The gel composition may have an agar content of about 8 percent by weight. The gel composition may have a fibers content of about 6.8 percent by weight. The fibers may be cellulose fibers with lengths of about 8 to about 15 micrometres. The gel composition may have a low methoxyl pectin (E440i) content of about 5 percent by weight. The gel composition may have a lactic acid content of about 2.1 percent by weight. The gel composition may have a Ca-lactate content of about 1 percent by weight. The gel composition may have a menthol extract (FDA 21CFR182.20), having a minimum of 55 percent menthol ($C_{10}H_{20}O$) content of about 2 percent by weight.

The gel composition may have a glycerin content of about 61 percent by weight. The gel composition may have a hydroxypropylmethyl cellulose content of about 21 percent by weight. The gel composition may have a nicotine content of about 1.8 percent by weight. The gel composition may have an agar content of about 3 percent by weight. The gel composition may have a fibers content of about 7.2 percent by weight. The fibers may be cellulose fibers with lengths of about 8 to about 15 micrometres. The gel composition may have a low methoxyl pectin (E440i) content of about 3 percent by weight. The gel composition may have a lactic acid content of about 3 percent by weight.

The gel composition may have a glycerin content of about 60 percent by weight. The gel composition may have a hydroxypropylmethyl cellulose content of about 22 percent by weight. The gel composition may have a nicotine content of about 1.8 percent by weight. The gel composition may have an agar content of about 2.4 percent by weight. The gel composition may have a fibers content of about 5.3 percent by weight. The fibers may be cellulose fibers with lengths of about 8 to about 15 micrometres. The gel composition may have a low methoxyl pectin (E440i) content of about 4 percent by weight. The gel composition may have a lactic acid content of about 2.8 percent by weight. The gel composition may have a Ca-lactate composition of about 1 percent by weight. The gel composition may have a vanilla extract (FDA 21CFR169.175), having a minimum of 20 percent vanillin ($C_8H_8O_3$) content of about 1.7 percent by weight.

The term "filter" is used to indicate a section of the aerosol-generating article that is configured to remove at least partially gas phase or particulate phase constituents or both gas phase and particulate phase constituents from the mainstream aerosol drawn through the filter.

The filter may be disposed immediately downstream of the tubular element in the longitudinal direction.

As the tubular element may be useful and sufficient to provide a customisation of the formed aerosol in accordance with a user's preference, the filter may be disposed immediately downstream of the tubular element, that is, without intermediate parts such as an aerosol-cooling element. Hence, the aerosol-generating article may achieve a reduction of gas and particulate phase constituents while needing less production steps and allowing a more consistent experience.

However, the aerosol-generating article may comprise an aerosol-cooling element downstream of the tubular element. Preferably, the aerosol-cooling element may be disposed between the tubular element and the filter.

The aerosol-generating article may comprise a mouthpiece disposed on the upstream end of the aerosol-generating article. The provision of a mouthpiece may be desirable to facilitate the inhalation of aerosol by a user.

The aerosol-generating article may comprise a wrapper circumscribing at least part of the aerosol-generating article. Advantageously, such a wrapper may prevent a user from handling the aerosol-forming substrate, which helps to maintain a high level of hygiene. The wrapper may be made from any suitable material. In particular, the wrapper may be formed from a porous material. The wrapper may be made from a material that permits volatile compounds to be released when the wrapper is disposed around a downstream section of the aerosol-generating article.

Advantageously, the wrapper may hold together a plurality of components of the aerosol-generating article. For example, the wrapper may hold the aerosol-forming substrate and the tubular element together. When the aerosol-generating article comprises a filter, the wrapper may hold the filter and the tubular element together.

Advantageously, the provision of one or more wrappers may improve the structural integrity of the aerosol-generating article.

The components of the aerosol-generating article may be secured together by any suitable means. For example, the aerosol-generating article may comprise a connection mechanism. The connection mechanism may contribute to holding the components of the aerosol-generating article together.

When a wrapper circumscribing at least part of the aerosol-generating article is provided and the aerosol-generating article comprises a connection mechanism, the wrapper may be configured to exert pressure on the connection mechanism.

The aerosol-forming substrate may have any suitable transverse cross-section. For example, the substrate may have a circular, oval, stadium shaped, rectangular or triangular transverse cross-sectional shape. Preferably, the substrate has a circular transverse cross-sectional shape.

The solid aerosol-forming substrate may comprise a plug of tobacco. The plug of tobacco may comprise, for example, one or more of: powder, granules, pellets, shreds, strands, strips or sheets containing one or more of: herb leaf, tobacco leaf, tobacco ribs, expanded tobacco and homogenised tobacco. As used herein, the term 'homogenised tobacco material' denotes a material formed by agglomerating particulate tobacco. Providing homogenised tobacco material may improve aerosol generation, the nicotine content and the flavour profile of the aerosol generated during heating of the aerosol-generating article. Specifically, the process of making homogenised tobacco involves grinding tobacco leaf, which more effectively enables the release of nicotine and flavours upon heating. Where the tobacco plug comprises homogenised tobacco material, the homogenised tobacco material may be in the form of a sheet. As used herein, the term 'sheet' denotes a laminar element having a width and length substantially greater than the thickness thereof.

The solid aerosol-forming substrate may comprise homogenised tobacco material. The solid aerosol-forming material may comprise shreds, strands or strips of homogenised tobacco material. The solid aerosol-forming substrate may comprise a sheet of homogenised tobacco material.

The aerosol-forming substrate may have a substantially homogenous composition. The aerosol-forming substrate may have a substantially homogeneous composition in at least the longitudinal direction.

A sheet of homogenised tobacco material may be formed by agglomerating particulate tobacco obtained by grinding or otherwise comminuting one or both of tobacco leaf lamina and tobacco leaf stems. A sheet of homogenised tobacco material may comprise one or more of tobacco dust, tobacco fines and other particulate tobacco by-products formed during, for example, the treating, handling and shipping of tobacco. A sheet of homogenised tobacco material is preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The solid aerosol-forming substrate may comprises a gathered sheet of homogenised tobacco material. As used herein, the term 'gathered' is used to describe a sheet that is convoluted, folded, or otherwise compressed or constricted substantially transversely to a longitudinal axis of the aerosol-generating article.

The aerosol-forming substrate comprises a gathered textured sheet of homogenised tobacco material. As used herein, the term 'textured sheet' denotes a sheet that has been crimped, embossed, debossed, perforated or otherwise deformed. Use of a textured sheet of homogenised tobacco material may advantageously facilitate gathering of the sheet of homogenised tobacco material to form the aerosol-forming substrate. The aerosol-forming substrate may comprise a gathered textured sheet of homogenised tobacco material comprising a plurality of spaced-apart indentations, protrusions, perforations or a combination thereof.

Preferably, the aerosol-forming substrate comprises a gathered crimped sheet of homogenised tobacco material. As used herein, the term 'crimped sheet' denotes a sheet having a plurality of substantially parallel ridges or corrugations. Preferably, the substantially parallel ridges or corrugations extend along or parallel to a longitudinal axis of the aerosol-generating article. This advantageously facilitates gathering of the crimped sheet of homogenised tobacco material to form the aerosol-generating article. However, it will be appreciated that crimped sheets of homogenised tobacco material for inclusion in the aerosol-generating article may have a plurality of substantially parallel ridges or corrugations that are disposed at an acute or obtuse angle to the longitudinal axis of the aerosol-generating article.

The aerosol-forming substrate may comprise tobacco-containing material and non-tobacco containing material.

The aerosol-forming substrate may comprise an aerosol former. The aerosol-forming substrate may comprise a single aerosol former or a combination of two or more aerosol formers. As used herein, the term 'aerosol former' is used to describe any suitable known compound or mixture of compounds that, in use, facilitates formation of an aerosol and that is substantially resistant to thermal degradation at the operating temperature of the aerosol-generating article. Suitable aerosol-formers include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Preferred aerosol formers are polyhydric alcohols or mixtures thereof, such as propylene glycol, triethylene glycol, 1,3-butanediol and, most preferred, glycerine. The aerosol-forming substrate may have an aerosol former content of greater than 5 percent on a dry weight basis. The aerosol aerosol-forming substrate may have an aerosol former content of between about 5 percent and about 30 percent on a dry weight basis. The aerosol-forming substrate may have an aerosol former content of about 20 percent on a dry weight basis.

The aerosol-forming substrate preferably comprises homogenised tobacco material, an aerosol-former and water.

The homogenised tobacco material may be provided in sheets which are one of folded, crimped or cut into strips. The sheets may be cut into strips having a width of between about 0.2 millimetres and about 2 millimetres, more preferably between about 0.4 millimetres and about 1.2 millimetres. The width of the strips may be about 0.9 millimetres.

The aerosol-forming substrate may comprise an inner cavity. In other words, the aerosol-forming substrate may be a tubular substrate. The aerosol-forming substrate may comprise a substrate inner surface having a substrate inner diameter, the substrate inner surface delimiting an inner cavity extending in the longitudinal direction within the aerosol-forming substrate. Providing an inner cavity into the aerosol-forming substrate may enable a heating element to be inserted into the aerosol-forming substrate, in the cavity, without piercing the substrate and altering the structure of the substrate. The provision of an inner cavity may also be beneficial to further reduce the thickness of the aerosol-forming substrate, enhancing the heat transfer advantages explained above.

When the aerosol-forming substrate comprises a substrate inner surface delimiting an inner cavity, the substrate inner surface may have the same transverse cross-sectional shape as the substrate outer surface. In particular, the substrate inner surface may have a substantially circular, oval or stadium shaped transverse cross-section.

The aerosol-generating article may comprise a layer of thermally conductive material. The layer of thermally conductive material may cover at least part of at least an otherwise exposed aerosol-forming substrate. The layer of thermally conductive material may be disposed on at least the substrate outer surface. The layer of thermally conductive material may be disposed on at least the substrate inner surface. The layer of thermally conductive material may be disposed on at least the substrate inner surface and on the substrate outer surface. Providing a layer of thermally conductive material on an otherwise exposed substrate surface may enable heat from a heating element to be received by or engaged with the substrate to be distributed over a broader area of the aerosol-forming substrate, improving heat transfer efficiency between a heating element and the aerosol-forming substrate. The layer of thermally conductive material may also create a physical separation between a heating element received in the inner cavity and the aerosol-forming substrate, which may reduce the risk of overheating the aerosol-forming substrate in regions of the substrate close to the heating element. The layer of thermally conductive material may also increase the robustness of the tubular aerosol-forming substrate, which may have been reduced by the reduction in the thickness of the substrate by the provision of the inner cavity.

As used herein, "thermally conductive" refers to a material having a thermal conductivity of at least 10 W/m·k, preferably at least 40 W/m·k, more preferably at least 100 W/m·k at 23 degrees Celsius and a relative humidity of 50%. Preferably, the layer of thermally conductive material may comprise material having a thermal conductivity of at least 40 W/m·k, preferably at least 100 W/m·k, more preferably at least 150 W/m·k, and even more preferably at least 200 W/m·k at 23 degrees Celsius and a relative humidity of 50%.

Examples of suitable conductive materials include, but are not limited to, aluminium, copper, zinc, nickel, silver, and combinations thereof.

The aerosol-forming substrate may have a rod comprising a plurality of elongate tube-like elements. The elongate tube-like elements may contain tobacco material. The plurality of elongate tube-like elements comprised in the aerosol-forming substrate must not be mistaken for the tubular element disposed downstream of the aerosol-forming substrate.

By adjusting the number, equivalent diameter and thickness of the elongate tube-like elements in the rod, it may be advantageously possible to adjust the density and porosity of the rod. In general, aerosol-forming substrates comprising a plurality of elongate tube-like elements of homogenised tobacco may advantageously exhibit more uniform densities than aerosol-forming substrates comprising shreds of tobacco material. The geometry of the elongate tube-like elements may be such that particularly stable channels are provided for airflow along the rod. This may advantageously allow a consistent fine tuning of RTD, such that aerosol-forming substrates having a predetermined RTD may be manufactured consistently and with great precision.

The weight of an aerosol-forming substrate comprising elongate tube-like elements of homogenised tobacco may be determined by the number, size, density and spacing of the tube-like elements. This may reduce inconsistencies in weight between aerosol-forming substrates of the same dimensions, and so result in lower rejection rate of aerosol-forming substrates whose weight falls outside of a selected acceptance range compared to aerosol-forming substrate comprising shreds of tobacco material.

Variations in the thickness of the elongate tube-like elements in the rod may also be advantageously used to adjust the content of homogenised tobacco in the rod. For example, in an elongate tube-like element formed from a rolled strip of homogenised tobacco web an adjustment of the thickness of the elongate tube-like element may be achieved by varying the number of convolutions of the strip about the longitudinal axis or by varying the thickness of the homogenised tobacco web itself. This may impart an increased design flexibility compared with aerosol-generating articles comprising shreds of tobacco material.

The size, geometry and arrangement of the elongate tube-like elements in the rod may be readily adapted to facilitate the insertion of a heating element in the rods of aerosol-generating articles. Because the elongate tube-like elements lie substantially straight within the rod and extend longitudinally, insertion of a longitudinally extending internal heating element, such as a heater blade, may be facilitated. The regular arrangement of the elongate tube-like elements in the rod can also advantageously favour optimisation of heat transfer from the heating element through the rod.

The insertion (and removal) of a heater of an aerosol-generating device into (from) an aerosol-forming substrate comprising shreds of tobacco material may tend to dislodge shreds of tobacco material from the aerosol-forming substrate. This can result in the need for more frequent cleaning of the heater element and other parts of the aerosol-generating device in order to remove the dislodged shreds. In contrast, insertion and removal of a heater of an aerosol-generating device into and from an aerosol-forming substrate comprising a plurality of elongate tube-like elements of homogenised tobacco material may advantageously have a significantly reduced tendency to dislodge material.

Rods comprising a plurality of elongate tube-like elements may be made in a continuous process which can be efficiently carried out at high speed, and can be conveniently incorporated into existing production lines for the manufacture of aerosol-generating articles.

The rod of aerosol-forming substrate preferably has an external diameter that is approximately equal to the external diameter of the aerosol-generating article.

The rod of aerosol-forming substrate may have an external diameter of at least 5 millimetres. The rod of aerosol-forming substrate may have an external diameter of between about 5 millimetres and about 12 millimetres, for example of between about 5 millimetres and about 10 millimetres or of between about 6 millimetres and about 8 millimetres. Preferably, the rod of aerosol-forming substrate may have an external diameter of 7.2 millimetres, to within 10 percent.

The rod of aerosol-forming substrate may have a length of between about 5 millimetres and about 100 mm. Preferably, the rod of aerosol generating substrate has a length of at least about 5 millimetres, more preferably at least about 7 millimetres. The rod of aerosol generating substrate preferably has a length of less than about 80 millimetres, more preferably less than about 65 millimetres, even more preferably less than about 50 millimetres. Preferably, the rod of aerosol generating substrate may have a length of less than about 35 millimetres, more preferably less than 25 millimetres, even more preferably less than about 20 millimetres. The rod of aerosol-forming substrate may have a length of about 10 millimetres; the rod of aerosol-forming substrate may have a length of about 12 millimetres.

The rod of aerosol-forming substrate may have a substantially uniform cross-section along the length of the rod. The rod of aerosol-forming substrate may preferably have a substantially circular cross-section.

The rod comprising elongate tube-like elements may be circumscribed by a wrapper. The elongate tube-like elements may be assembled such that the elongate tube-like elements extend in the longitudinal direction.

The plurality of elongate tube-like elements of the rod of aerosol-generating articles according to the invention may be formed of a homogenous tobacco material, which may comprise particulate tobacco obtained by grinding. The plurality of elongate tube-like elements may all have substantially the same composition as each other. Likewise, the plurality of elongate tube-like elements may include tube-like elements of at least two different compositions.

At least one elongate tube-like element in the rod may comprise a rolled strip cut from a sheet or web of homogenised tobacco material.

The sheets or webs of homogenised tobacco material may have a tobacco content of at least about 40 percent by weight on a dry weight basis, more preferably of at least about 60 percent by weight on a dry weight basis, more preferably or at least about 70 percent by weight on a dry basis and most preferably at least about 90 percent by weight on a dry weight basis.

The sheets or webs of homogenised tobacco material for use in the aerosol-forming substrate may comprise one or more intrinsic binders, that is, tobacco endogenous binders, one or more extrinsic binders, that is, tobacco exogenous binders, or a combination thereof to help agglomerate the particulate tobacco. Sheets of homogenised tobacco material for use in the aerosol-forming substrate may comprise other additives including, but not limited to, tobacco and non-tobacco fibres, aerosol formers, humectants, plasticisers, flavourants, fillers, aqueous and non-aqueous solvents and combinations thereof.

Suitable extrinsic binders for inclusion in sheets or webs of homogenised tobacco material for use in the aerosol-forming substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets or webs of homogenised tobacco material for use in the aerosol-forming substrate are known in the art and include, but are not limited to: cellulose fibers; soft-wood fibres; hard-wood fibres; jute fibres and combinations thereof. Prior to inclusion in sheets of homogenised tobacco material for use in the aerosol-forming substrate, non-tobacco fibres may be treated by suitable processes known in the art including, but not limited to: mechanical pulping; refining; chemical pulping; bleaching; sulfate pulping; and combinations thereof.

The sheets or webs of homogenised tobacco material may comprise the aerosol former.

The sheets or webs of homogenised tobacco for use in the aerosol-generating article of the present invention may be made by methods known in the art, for example the methods disclosed in international patent application WO-A-2012/164009 A2. The sheets of homogenised tobacco material for use in the aerosol-generating article may be formed from a slurry comprising particulate tobacco, guar gum, cellulose fibres and glycerine by a casting process.

Likewise, elongate tube-like elements of homogenised tobacco material for use in an aerosol-forming substrate in accordance with the invention may be formed by extrusion. By way of example, a slurry comprising particulate tobacco obtained by grinding or otherwise comminuting tobacco leaf lamina may be pushed through a die of the desired cross-section. Moreover, additive manufacturing may also be used for manufacturing tube-like elements of homogenised tobacco material.

The elongate tube-like element may have an equivalent diameter from about 0.03 millimetres to about 3 millimetres. Preferably, the elongate tube-like element may have an equivalent diameter of at least about 0.1 millimetres. More preferably, the elongate tube-like element may have an equivalent diameter of at least about 0.3 millimetres.

Likewise, the elongate tube-like element preferably may have an equivalent diameter of less than about 2 millimetres. More preferably, the elongate tube-like element may have an equivalent diameter of less than about 1 millimetre.

The elongate tube-like element may have an equivalent diameter from about 0.7 millimetres to about 2.7 millimetres; the elongate tube-like element may have an equivalent diameter from about 0.3 millimetres to about 1.1 millimetres.

Where the elongate tube-like element is formed by rolling a strip of homogenised tobacco material, the strip may have a width of at least about 1 millimetre. Preferably, the strip of homogenised tobacco material may have a width of at least about 2 millimetres. More preferably, the strip of homogenised material may have a width of at least about 3 millimetres.

The strip of homogenised tobacco material may have a width from about 1 millimetre to about 3.5 millimetres; the strip of homogenised tobacco material may have a width from about 2.4 millimetres to about 8.2 millimetres.

The strip of homogenised tobacco material may cut from a sheet or web having a thickness of at least about 40 microns, more preferably at least about 60 microns, more preferably at least about 80 microns and most preferably at least about 100 microns. Likewise, the strip of homogenised tobacco material may be cut from a sheet or web having a thickness of no more than about 5000 microns, more preferably no more than about 2000 microns, more preferably no more than about 1000 microns and most preferably no more than about 500 microns. For example, the thickness of the sheet or web may be between about 40 microns and about 5000 microns, more preferably between about 60 microns and about 2000 microns, more preferably between about 80 microns and about 1000 microns and most preferably by between about 100 microns and about 500 microns.

A thickness of the elongate tube-like element may be at least about 40 microns, more preferably at least about 80 microns, more preferably at least about 120 microns and most preferably at least about 160 microns. Likewise, a thickness of the elongate tube-like element may be less than about 5000 microns, more preferably less than about 2500 microns and most preferably less than about 1000 microns.

The elongate tube-like elements may be formed of a porous tobacco material, such that air flows through the wall of the tube-like element; that is, airflow along a substantially radial direction in the rod is not impeded. Where the elongate tube-like element is formed by rolling a strip of homogenised tobacco material the strip itself may be formed of a porous tobacco material.

As used herein with reference to a homogenised tobacco material, the term "porous" may indicate that the tobacco material has been produced within an inherent porosity so that sufficient pores or interstices are provided within the structure of a sheet or web such as to enable the flow of air through the sheet or web in a direction transverse to a surface of the sheet or web. Likewise, the term "porous" may indicate that each sheet or web of tobacco material comprises a plurality of air flow holes to provide the desired porosity. For example, a sheet of tobacco material may be punctured with a pattern of air flow holes prior to undergoing the rolling operation that produces the elongate tube-like elements of the rod of aerosol-forming substrate. The air flow holes may be punctured randomly or uniformly over the sheet. The pattern of air flow holes may cover substantially the full surface of the sheet, or may cover one or more specific areas of the sheet, with the remaining areas being free from air flow holes.

The strip of homogenised tobacco material from which the elongate tube-like element may be formed may be textured. For example, the sheet or web from which the strip is cut may comprise a plurality of spaced-apart indentations, protrusions, perforations or a combination thereof. Texture may be provided on one side of each sheet, or on both sides of each sheet.

The inclusion of one or more elongate tube-like elements formed from a crimped strip may help to provide and retain some spacing between adjacent tube-like elements within the rod.

An additive may be applied to at least a part of a surface of at least one of the plurality of tube-like elements. The additive may be a solid additive, a liquid additive, or a combination of a solid additive and a liquid additive. Suitable solid and liquid additives for use in the invention are known in the art and include, but are not limited to: flavourants, such as for example menthol; adsorbents, such as for example activated carbon; fillers, such as for example calcium carbonate; and botanical additives.

To form a substantially elongate tube-like element, the strip of homogenised tobacco material may be wound about the longitudinal axis by at least about 345 degrees. Preferably, the strip of homogenised tobacco material may be wound about the longitudinal axis by at least about 360 degrees. More preferably, the strip of homogenised tobacco material may be wound about the longitudinal axis by at least about 540 degrees. Likewise, the strip of homogenised tobacco material may preferably be wound about the longitudinal axis by less than about 1800 degrees. More preferably, the strip of homogenised tobacco material may be wound about the longitudinal axis by less than about 900 degrees. Preferably, the strip of homogenised tobacco material may be wound about the longitudinal axis by from about 345 to about 540 degrees.

Each elongate tube-like element may have a length substantially equal to the length of the rod of aerosol-forming substrate. Each elongate tube-like element may have a length of about 10 millimetres; each elongate tube-like element may a length of about 12 millimetres.

The rod of aerosol-forming substrate may comprise less than about 200 elongate tube-like elements of homogenised tobacco material. More preferably, the rod of aerosol-forming substrate may comprise less than about 150 elongate tube-like elements. Even more preferably, the rod of aerosol-forming substrate may comprise less than about 100 elongate tube-like elements.

Likewise, the rod of aerosol-forming substrate may comprise at least about 15 elongate tube-like elements of homogenised tobacco material. More preferably, the rod of aerosol-forming substrate comprises at least about 30 elongate tube-like elements. Even more preferably, the rod of aerosol-forming substrate may comprise at least about 40 elongate tube-like elements. The rod of aerosol-forming substrate may comprise from about 15 to about 100 strands of non-tobacco material.

In the rod of the aerosol-forming substrate the elongate tube-like elements may be aligned substantially parallel to one another.

The elongate tube-like elements of homogenised tobacco material may have substantially oval cross-section; they may have a substantially elliptical transverse cross-section; they may a substantially circular transverse cross-section. As described above, elongate tube-like elements for use in aerosol-generating articles may effectively be formed by winding a strip of homogenised tobacco material about its longitudinal axis by slightly less than 360 degrees. This results in an element having effectively a C-shaped cross-section, wherein a slit extends longitudinally over the entire length of the elongate tube-like element.

The plurality of elongate tube-like elements forming the rod of aerosol-forming substrate may be circumscribed by a wrapper. The wrapper may be formed of a porous or non-porous sheet material. The wrapper may be formed of any suitable material or combination of materials. The wrapper may be a paper wrapper. The wrapper may optionally be adhered to the outer edges of the plurality of elongate tube-like elements. For example, at least one of the inner surface of the wrapper and the outer edges of the plurality of elongate tube-like elements may be wetted during the production process such that the inner wrapper adheres to the edges of the elongate tube-like elements during the wrapping process. Likewise, an adhesive may be applied to at least one of the inner surface of the wrapper and the outer edges of the plurality of elongate tube-like elements upstream of the wrapping step. The adhesion of the plurality of elongate tube-like elements and the wrapper may advantageously help to retain the position and spacing of the plurality of elongate tube-like elements within the rod.

The wrapper may be at least partially folded over the elongate tube-like elements at the upstream and downstream ends of the rod to retain the plurality of elongate tube-like elements within the rod. The wrapper may overlie the periphery of the plurality of elongate tube-like elements at the upstream and downstream ends of the rod so that the remainder of the elongate tube-like elements is exposed. The wrapper may overlie the entire upstream and downstream ends of the rod.

A separate rim section of paper or other material may be attached to the wrapper to overlie at least the periphery of the upstream and downstream ends of the elongate tube-like elements, as described above. When the wrapper is folded over the ends of the rod, or where a separate rim section is provided, an additional outer wrapper may be provided overlying the wrapper that circumscribes the plurality of elongate tube-like elements.

A rod for use in an aerosol-generating article as described above may be manufactured by a method as set out below. In a first step of the method, there may be provided a sheet or web of homogenised tobacco material. In a second step, an elongate strip having a longitudinal axis may be cut from the sheet or web of homogenised tobacco material. The cutting operation may be carried out by feeding the sheet or web from a roll or bobbin and by moving it in continuous fashion along a predetermined direction. Cutting means may be provided at a cutting station to which the web or sheet is fed. To this purpose, mechanical cutters may be used. Lasers can also be used.

In a third step, the strip may be rolled, that is, wound about the longitudinal axis to form an elongate tube-like element. This may be achieved by feeding the strip along a predetermined direction to a funnel shaped element, such that the strip is coiled and shaped into a rolled elongate tube-like element. Several individual rolled elongate tube-like elements may be manufactured in parallel.

In a fourth step, a plurality of elongate tube-like elements obtained at the end of the third step may be collated and assembled such that the elongate tube-like elements extend in the longitudinal direction. This may be achieved by feeding the plurality of elongate tube-like elements through another funnel element such that they are grouped in a substantially cylindrical cluster.

In a fifth step, the assembled elongate tube-like elements may be circumscribed with a wrapper to form a continuous rod. In a sixth step, the continuous rod may be severed into a plurality of discrete rods.

This method may comprise a further step of applying at least one aerosol former to the sheet or web of homogenised material prior to the step of cutting the sheet or web to obtain the strip. The method may also comprise a further step of applying at least one aerosol former to the elongate tube-like elements prior to the step of collating and assembling the plurality of elongate tube-like members.

Furthermore, the method may comprise a further step of applying at least one aerosol former to the plurality of elongate tube-like elements after they have been collated and assembled. Likewise, the method may comprise a step of applying at least one aerosol former to the plurality of elongate tube-like elements following the step of severing the continuous rod into discrete rods.

The method may further comprise a step of drying the homogenised tobacco material after the step of applying the at least one aerosol former.

An aerosol-generating system may be provided. The aerosol-generating system may comprise any of the aerosol-generating articles disclosed above and an aerosol-generating device comprising a heater for heating the aerosol-generating article. The heater may comprise a substrate heating element configured to heat the aerosol-forming substrate and a downstream heating element disposed downstream of the substrate heating element. The downstream heating element may be configured to heat the flavour substrate. The downstream heating element may be configured to heat the at least one permeability control element. The downstream heating element may be configured to heat the spanning element.

As used herein, the term "aerosol-generating system" refers to the combination of an aerosol-generating device and an aerosol-generating article.

Since the aerosol-generating system of this disclosure comprises an aerosol-generating article according to the previous disclosures, the advantages specified above for the aerosol-generating articles also apply to the system itself. In particular, the aerosol-generating device may be used to generate substrate aerosol and flavour aerosol upon heating of the aerosol-forming substrate and the flavour substrate, respectively. The aerosol-generating device may be used to achieve changes in the permeability of the flavour substrate, the at least one permeability control element, the spanning element and any combination thereof, depending on the configuration of the aerosol-generating article.

The substrate heating element and the downstream heating element may be any suitable type of heating element. The substrate heating element may be an internal heating element. The downstream heating element may be an internal heating element. As used herein, the term "internal heating element" refers to a heating element configured to be inserted into an aerosol-forming substrate or flavour substrate. The substrate heating element and the downstream heating element may be an elongate heating element. The elongate heating element may be blade-shaped. The elongate heating element may be pin-shaped. The elongate heating element may have a tapered shape, or at least a tapered end. The elongate heating element may have a pointed end. The heating element may be cone-shaped. The elongate heating element may be have any suitable shape arranged to facilitate insertion of the heating element into the aerosol-forming substrate or flavour substrate. Advantageously, an elongate heating element may provide easier engagement or easier disengagement or both easier engagement and easier disengagement of the aerosol-generating article with the heating element of the device.

The substrate heating element may be an external heating element. The downstream heating element may be an external heating element. As used herein, the term "external heating element" refers to a heating element configured to heat an outer surface of an aerosol-forming substrate or flavour substrate. The at least one external heating element may at least partially circumscribe the cavity for receiving the aerosol-forming substrate or the flavour substrate.

The heater may comprise at least one resistive heating element.

The substrate heating element may be an resistive heating element, that is, the heater may comprise a substrate resistive heating element. The downstream heating element may be an resistive heating element, that is, the heater may comprise a downstream resistive heating element.

The substrate resistive heating element and the downstream resistive heating element may be electrically connected in a parallel arrangement. Advantageously, providing a plurality of resistive heating elements electrically connected in a parallel arrangement may facilitate the delivery of a desired electrical power to the heating elements while reducing or minimising the voltage required to provide the desired electrical power. Advantageously, reducing or minimising the voltage required to operate the at least one heating element may facilitate reducing or minimising the physical size of the power supply.

The at least one resistive heating element may comprise an electrically insulating substrate and one or more electrically conductive tracks on the electrically insulating substrate.

The electrically insulating substrate may be stable at an operating temperature of the at least one heating element. The electrically insulating substrate may be stable at temperatures of up to about 400 degrees Celsius, more preferably about 500 degrees Celsius, more preferably about 600 degrees Celsius, more preferably about 700 degrees Celsius, most preferably about 800 degrees Celsius.

The operating temperature of the at least one resistive heating element during use may be at least about 200 degrees Celsius. The operating temperature of the at least one resistive heating element during use may be less than about 700 degrees Celsius. The operating temperature of the at least one resistive heating element during use may be less than about 600 degrees Celsius. The operating temperature of the at least one resistive heating element during use may be less than about 500 degrees Celsius. The operating temperature of the at least one resistive heating element during use may be less than about 400 degrees Celsius.

The electrically insulating substrate may comprise any suitable material. For example, the electrically insulating substrate may comprise one or more of: paper, glass, ceramic, anodized metal, coated metal, and Polyimide. The ceramic may comprise mica, Alumina ($Al_2O_3$) or Zircona ($ZrO_2$). The electrically insulating substrate may have a thermal conductivity of less than or equal to about 40 Watts per metre Kelvin, preferably less than or equal to about 20 Watts per metre Kelvin and ideally less than or equal to about 2 Watts per metre Kelvin.

Suitable materials for forming the resistive heating element, and in particular the one or more electrically conductive tracks, may include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys.

The resistive heating element may comprise one or more stamped portions of electrically resistive material, such as stainless steel. The at least one resistive heating element may comprise a heating wire or filament, for example a Ni—Cr (Nickel-Chromium), platinum, tungsten or alloy wire.

The heater may comprise at least one inductive heating arrangement.

The substrate heating element may be an inductive heating arrangement, that is, the heater may comprise a substrate inductive heating arrangement. The downstream heating element may be an inductive heating arrangement, that is, the heater may comprise a downstream inductive heating arrangement.

The at least one inductive heating arrangement may comprise at least one inductor coil. The at least one inductive heating arrangement may comprise a substrate inductor coil. The at least one inductive heating arrangement may comprise a downstream inductor coil. The inductor coil is arranged to generate a varying magnetic field on receiving a varying current from a power supply. Such varying current may be between about 5 kilohertz and about 500 kilohertz. The varying current may be a high frequency varying current. As used herein, the term "high frequency varying current" means a varying current having a frequency of between about 500 kilohertz and about 30 megahertz. The high frequency varying current may have a frequency of between about 1 megahertz and about 30 megahertz, such as between about 1 megahertz and about 10 megahertz, or such as between about 5 megahertz and about 8 megahertz. The varying current may be an alternating current which generates an alternating magnetic field.

The inductor coil may have any suitable form. For example, the inductor coil may be a flat inductor coil. The flat inductor coil may be wound in a spiral, substantially in a plane. Preferably, the inductor coil may be a tubular inductor coil. Typically, the tubular inductor coil may be helically wound about a longitudinal axis. The inductor coil may be elongate. Particularly preferably, the inductor coil may be an elongate tubular inductor coil. The inductor coil may have any suitable transverse cross-section. For example, the inductor coil may have a circular, elliptical, square, rectangular, triangular or other polygonal transverse cross-section.

The inductor coil may be formed from any suitable material. The inductor coil may be formed from an electrically conductive material. Preferably, the inductor coil may be formed from a metal or a metal alloy.

As used herein, "electrically conductive" refers to materials having an electrical resistivity of less than or equal to 1 x10-4 ohm metres (Ω·m), at twenty degrees Celsius.

The at least one inductive heating arrangement may comprise at least one susceptor. The at least one inductive heating arrangement may comprise a substrate susceptor. The at least one inductive heating arrangement may comprise a downstream susceptor. As used herein, the term "susceptor" refers to an element comprising a material that is capable of converting magnetic energy into heat. When a susceptor is located in a varying magnetic field, such as the varying magnetic field generated by an inductor coil, the susceptor is heated. For example, when the substrate susceptor is located in a varying magnetic field generated by the susbtrate inductor coil, the substrate susceptor may be heated; when the downstream susceptor is located in a varying magnetic field generated by the downstream inductor coil, the downstream susceptor may be heated.

Heating of the susceptor may be the result of hysteresis losses and/or eddy currents induced in the susceptor, depending on the electrical and magnetic properties of the susceptor material. Hysteresis losses occur in ferromagnetic or ferrimagnetic susceptor materials due to magnetic domains within the material being switched under the influence of a varying electromagnetic field. Eddy currents may be induced if the susceptor material is electrically conductive. In case of an electrically conductive ferromagnetic or ferrimagnetic susceptor material, heat can be generated due to both eddy currents and hysteresis losses. Accordingly, the susceptor may be heatable due to at least one of hysteresis losses or eddy currents, depending on the electrical and magnetic properties of the susceptor material.

The susceptor is arranged such that, when the aerosol-generating article is received in the aerosol-generating device, the oscillating electromagnetic field generated by the inductor coil may induce a current in the susceptor, causing the susceptor to heat up. The aerosol-generating device may preferably be capable of generating a fluctuating electromagnetic field having a magnetic field strength (H-field strength) of between 1 and 5 kilo amperes per metre (kA m), preferably between 2 and 3 kA/m, for example about 2.5 kA/m. The aerosol-generating device may preferably be capable of generating a fluctuating electromagnetic field having a frequency of between 1 and 30 MHz, for example between 1 and 10 MHz, for example between 5 and 7 MHz.

The susceptor may comprise any suitable material. The susceptor may be formed from any material that can be inductively heated to a temperature sufficient to release volatile compounds from the aerosol-forming substrate or the flavour substrate. Preferred susceptors may be heated to a temperature in excess of about 250 degrees Celsius. Preferred susceptors may be formed from an electrically conductive material. Suitable materials for the susceptor include graphite, molybdenum, silicon carbide, stainless steels, niobium, aluminium, nickel, nickel containing compounds, titanium, and composites of metallic materials. Preferred susceptors may comprise a metal or carbon. Some preferred susceptors may comprise a ferromagnetic material, for example, ferritic iron, a ferromagnetic alloy, such as ferromagnetic steel or stainless steel, ferromagnetic particles, and ferrite. Some preferred susceptors may consist of a ferromagnetic material. The suitable susceptor may comprise aluminium. The suitable susceptor may consist of aluminium. The susceptor may comprise at least about 5 percent, at least about 20 percent, at least about 50 percent or at least about 90 percent of ferromagnetic or paramagnetic materials.

Preferably, the susceptor may be formed from a material that is substantially impermeable to gases. In other words, preferably, the susceptor may be formed from a material that is not gas permeable.

The susceptor may have any suitable form. For example, the susceptor may be elongate. The susceptor may have any suitable transverse cross-section. For example, the susceptor may have a circular, elliptical, square, rectangular, triangular or other polygonal transverse cross-section. The susceptor may be tubular.

The susceptor may comprise a susceptor layer provided on a support body. Arranging the susceptor in a varying magnetic field may induce eddy currents in close proximity to the susceptor surface, in an effect that is referred to as the skin effect. Accordingly, it is possible to form the susceptor from a relatively thin layer of susceptor material, while ensuring the susceptor is effectively heated in the presence of a varying magnetic field. Making the susceptor from a support body and a relatively thin susceptor layer may facilitate manufacture of an aerosol-generating article that is simple, inexpensive and robust.

The support body may be formed from a material that is not susceptible to inductive heating. Advantageously, this may reduce heating of surfaces of the susceptor that are not in contact with an aerosol-forming substrate, where surfaces of the support body form surfaces of the susceptor that are not in contact with an aerosol-forming substrate.

The support body may comprise an electrically insulative material. As used herein, "electrically insulating" refers to materials having an electrical resistivity of at least 1 x104 ohm metres (Om), at twenty degrees Celsius.

Forming the support body from a thermally insulative material may provide a thermally insulative barrier between the susceptor layer and other components of an inductive heating arrangement, such as an inductor coil circumscribing the inductive heating element. Advantageously, this may reduce heat transfer between the susceptor and other components of an inductive heating system.

The thermally insulative material may also have a bulk thermal diffusivity of less than or equal to about 0.01 square centimetres per second ($cm^2/s$) as measured using the laser flash method. Providing a support body having such a thermal diffusivity may result in a support body with a high thermal inertia, which may reduce heat transfer between the susceptor layer and the support body, and reduce variations in the temperature of the support body.

The susceptor may be provided with a protective outer layer, for example a protective ceramic layer or protective glass layer. A protective outer layer may improve the durability of the susceptor and facilitate cleaning of the susceptor. The protective outer layer may substantially surround the susceptor. The susceptor may comprise a protective coating formed from a glass, a ceramic, or an inert metal.

The susceptor may have any suitable dimensions. The susceptor may have a length of between about 5 millimetres and about 15 millimetres, for example between about 6 millimetres and about 12 millimetres, or between about 8 millimetres and about 10 millimetres. The susceptor may have a width of between about 1 millimetre and about 8 millimetres, for example between about 3 millimetres and about 5 millimetres. The susceptor may have a thickness of between about 0.01 millimetres and about 2 millimetres. Where the susceptor has a constant cross-section, for example a circular cross-section, the susceptor may have a preferable width or diameter of between about 1 millimetre and about 5 millimetres.

The susceptor may be located in a device cavity. The susceptor may extend into the device cavity in the longitudinal direction of the device cavity. The susceptor may be elongate. The elongate susceptor may be blade-shaped. The elongate susceptor may be pin-shaped. The elongate susceptor may have a tapered shape, or at least a tapered end. The elongate susceptor may have a pointed end. The elongate element may be cone-shaped.

The substrate susceptor may be an internal heating element configured to be at least partially inserted into the aerosol-forming substrate of the aerosol-generating article when the aerosol-generating article is received in the device cavity. Where the aerosol-forming substrate comprises an inner cavity, the substrate susceptor may be configured to be at least partially inserted into the inner cavity of the aerosol-forming substrate when the aerosol-generating article is received in the device cavity.

The downstream susceptor may be an internal heating element configured to be at least partially inserted into the flavour substrate of the aerosol-generating article when the aerosol-generating article is received in the device cavity.

The substrate susceptor may be an external heating element configured to at least partially circumscribe the cavity for receiving the aerosol-forming substrate.

The downstream susceptor may be an external heating element configured to at least partially circumscribe the cavity for receiving the flavour substrate.

The inductive heating arrangement may comprise at least one internal heating element and at least one external heating element.

The heater may comprise at least one resistive heating element and at least one inductive heating element. The heater may comprise a combination of resistive heating elements and inductive heating elements.

The aerosol-generating device may comprise a power supply. The power supply may be a DC voltage source. The power supply may be a battery. For example, the power supply may be a nickel-metal hydride battery, a nickel cadmium battery, or a lithium based battery, for example a lithium-cobalt, a lithium-iron-phosphate or a lithium-polymer battery. The power supply may be another form of charge storage device such as a capacitor. The power supply may require recharging and may have a capacity that allows for the storage of enough energy for use of the aerosol-generating device.

The power supply may be electrically connected to the heater for supplying power to the heating elements, such as the substrate heating element and the downstream heating element. When the heating element receives electrical power from the power supply, the heating element may generate heat. The power supply may be configured to supply sufficient power to the substrate heating element to heat the aerosol-forming substrate to a temperature at which volatile compounds are released from the aerosol-forming substrate. The power supply may be configured to supply sufficient power to the downstream heating element to heat the flavour substrate to a temperature at which volatile compounds are released from the flavour substrate. The power supply may be configured to supply sufficient power to the downstream heating element to heat the at least one permeability control element to a temperature at which the at least one permeability control element is fluid permeable, that is, to heat the at least one permeability control element to its permeability transition temperature.

The aerosol-generating device may comprise a housing. The housing may at least partially define the cavity for receiving an aerosol-generating article.

The aerosol-generating device may comprise at least one device air inlet in fluid communication with the cavity. When the aerosol-generating device comprises a housing, the housing may at least partially define the at least one device air inlet. The housing may define a substrate device air inlet in close proximity to the distal end of the cavity. The substrate device air inlet may be desirable to enable ambient air to be drawn into the upstream end of the aerosol-forming substrate. The housing may also define a downstream device air inlet. The downstream device air inlet may be advantageous to enable ambient air to be drawn into the air inlet of the tubular element. The downstream device air inlet may be configured to substantially match the air inlet of the tubular element when the aerosol-generating article is fully introduced into the cavity for receiving an aerosol-generating article.

The aerosol-generating device may comprise a controller. The controller may be configured to control the supply of power from the power supply to the heating elements. The controller may be any suitable controller. The controller may comprise any suitable electrical circuitry and electrical components. The controller may comprise a processor and a memory. The controller may comprise a microprocessor, which may be a programmable microprocessor.

The aerosol-generating device may comprise a sensor to detect airflow indicative of a user taking a puff. The air flow sensor may be an electro-mechanical device. The airflow sensor may be any of: a mechanical device, an optical device, an opto-mechanical device and a micro electro-mechanical systems (MEMS) based sensor. The aerosol-generating device may comprise a manually operable switch for a user to initiate a puff.

The aerosol-generating device may comprise an indicator for indicating when the at least one heating element is activated. The indicator may comprise a light, activated when the at least one heating element is activated.

The aerosol-generating device may comprise at least one electrical connector. The at least one electrical connector may be configured to charge the power supply. The at least one electrical connector may be configured to be connected to another electrical device. The at least one electrical connector may comprise an external plug or socket comprising at least one external electrical contact allowing the aerosol-generating device to be connected to another electrical device. For example, the aerosol-generating device may comprise a USB plug or a USB socket to allow connection of the aerosol-generating device to another USB enabled device. For example, the USB plug or socket may allow connection of the aerosol-generating device to a USB charging device to charge a rechargeable power supply within the aerosol-generating device. The USB plug or socket may support the transfer of data to or from, or both to and from, the aerosol-generating device. Likewise, the aerosol-generating device may be connected to a computer to transfer data to the device, such as new heating profiles for new aerosol-generating articles.

When the aerosol-generating device comprises a USB plug or socket, the aerosol-generating device may further comprise a removable cover that covers the USB plug or socket when not in use. When the USB plug or socket is a USB plug, the USB plug may be selectively retractable within the device.

The invention is defined in the claims. However, below there is provided a non-exhaustive list of non-limiting examples. Any one or more of the features of these examples may be combined with any one or more features of another example, embodiment or disclosure described herein.

Ex1a. An aerosol-generating article having an upstream end and a downstream end, the aerosol-generating article defining a longitudinal direction between the upstream end and the downstream end, the aerosol-generating article comprising:

an aerosol-forming substrate;

a tubular element disposed downstream of the aerosol-forming substrate and extending along the longitudinal direction, the tubular element comprising an inner tube and an outer tube, the outer tube being disposed around the inner tube, wherein an outer airflow channel is longitudinally delimited by the inner tube and the outer tube, wherein an inner airflow channel is longitudinally delimited by the inner tube, and wherein at least the inner airflow channel is adapted for substrate aerosol to flow towards the downstream end; and at least one permeability control element disposed within the outer airflow channel, preferably wherein the at least one permeability control element is or comprises a flavour substrate disposed downstream of the aerosol-forming substrate.

Ex1. An aerosol-generating article having an upstream end and a downstream end, the aerosol-generating article defining a longitudinal direction between the upstream end and the downstream end, the aerosol-generating article comprising:

an aerosol-forming substrate;

a tubular element disposed downstream of the aerosol-forming substrate and extending along the longitudinal direction, the tubular element comprising an inner tube and an outer tube, the outer tube being disposed around the inner tube, wherein an outer airflow channel is longitudinally delimited by the inner tube and the outer tube, wherein an inner airflow channel is longitudinally delimited by the inner tube, and wherein at least the inner airflow channel is adapted for substrate aerosol to flow towards the downstream end;

a flavour substrate disposed downstream of the aerosol-forming substrate; and at least one permeability control element disposed within the outer airflow channel.

Ex2. The aerosol-generating article of Ex1a or Ex1, wherein the at least one permeability control element is configured to be fluid permeable when the temperature of the at least one permeability control element is equal to or greater than a permeability transition temperature of the at least one permeability control element, wherein preferably the permeability transition temperature of the at least one permeability control element is a phase transition temperature of the at least one permeability control element, wherein the at least one permeability control element is configured to be substantially fluid impermeable when the temperature of the at least one permeability control element is lower than the permeability transition temperature of the at least one permeability control element, and wherein the at least one permeability control element being configured to prevent a fluid from flowing along the outer airflow channel downstream of the permeability control element when the temperature of the at least one permeability control element is lower than the permeability transition temperature of the at least one permeability control element, and to allow a fluid to flow along the outer airflow channel downstream of the permeability control element when the temperature of the at least one permeability control element is equal to or greater than the permeability transition temperature of the at least one permeability control element.

Ex3. The aerosol-generating article of Ex1 or Ex2, wherein the at least one permeability control element is configured to prevent a fluid from flowing along the outer airflow channel downstream of the permeability control element when the temperature of the at least one permeability control element is 20 degrees Celsius and to allow a fluid to flow along the outer airflow channel downstream of the permeability control element when the temperature of the at least one permeability control element is 85 degrees Celsius.

Ex4. The aerosol-generating article of any one of Ex1 to Ex3, wherein the at least one permeability control element comprises a gel composition.

Ex5. The aerosol-generating article of any one of Ex1 to Ex4, wherein the at least one permeability control element comprises a thermo-reversible material, such as a thermo-reversible gel composition.

Ex6. The aerosol-generating article of any one of Ex1 to E5, wherein the flavour substrate is disposed within the outer airflow channel.

Ex7. The aerosol-generating article of Ex6, wherein the flavour substrate is a permeability control element.

Ex8. The aerosol-generating article of any one of Ex6 to Ex7, wherein a permeability control element is disposed downstream of the flavour substrate.

Ex9. The aerosol-generating article of any one of Ex1 to Ex8, further comprising a spanning element disposed within the outer airflow channel upstream of the flavour substrate.

Ex10. The aerosol-generating article of Ex9, wherein the spanning element is a permeability control element.

Ex11. The aerosol-generating article of Ex7, wherein the flavour substrate extends longitudinally along the entire airflow channel.

Ex12. The aerosol-generating article according to any one of Ex1 to Ex11, further comprising an air inlet configured to allow for the intake of outside air into the outer airflow channel.

Ex13. The aerosol-generating article of Ex12 when depending on Ex9 or Ex10, wherein the air inlet is disposed downstream of the spanning element.

Ex14. The aerosol-generating article of Ex12 or Ex13, wherein the flavour substrate is disposed downstream of the air inlet.

Ex15. The aerosol-generating article of any one of Ex1 to Ex 14, wherein the tubular element is disposed immediately downstream of the aerosol-forming substrate in the longitudinal direction.

Ex16. The aerosol-generating article of any one of Ex1 to Ex15, further comprising a filter disposed downstream of the tubular element.

Ex17. The aerosol-generating article of Ex16, wherein the filter is disposed immediately downstream of the tubular element in the longitudinal direction.

Ex18. The aerosol-generating article of any one of Ex1 to Ex17, further comprising an aerosol cooling element disposed downstream of the tubular element in the longitudinal direction.

Ex19. The aerosol-generating article of Ex18 when depending on Ex16 or Ex17, wherein the aerosol-cooling element is disposed between the tubular element and the filter.

Ex20. The aerosol-generating article of any one of Ex1 to Ex19, further comprising a wrapper circumscribing at least part of the aerosol-generating article.

Ex21. The aerosol-generating article of any one of Ex1 to Ex20, further comprising a connection mechanism configured to hold two or more components of the aerosol-generating article together.

Ex 22. The aerosol-generating article of any one of Ex22 to Ex6, wherein the resistance to draw of the aerosol-generating article when the at least one permeability control element is fluid permeable is at least about 10 mm $H_2O$ greater than the resistance to draw of the aerosol-generating article when the at least one permeability control element is substantially fluid impermeable.

Ex23. The aerosol-generating article of Ex22, wherein the resistance to draw of the aerosol-generating article when the at least one permeability control element is fluid permeable is at least about 20 mm $H_2O$ greater than the resistance to draw of the aerosol-generating article when the at least one permeability control element is substantially fluid impermeable.

Ex24. The aerosol-generating article of Ex23, wherein the resistance to draw of the aerosol-generating article when the at least one permeability control element is fluid permeable is at least about 30 mm $H_2O$ greater than the resistance to draw of the aerosol-generating article when the at least one permeability control element is substantially fluid impermeable.

Ex25. The aerosol-generating article of any one of Ex1 to Ex24, wherein the resistance to draw of the aerosol-generating article when the at least one permeability control element is substantially fluid impermeable is greater than about 20 mm $H_2O$, preferably greater than about 30 mm $H_2O$, more preferably greater than about 40 mm $H_2O$, even more preferably greater than about 50 mm $H_2O$, most preferably greater than about 60 mm $H_2O$.

Ex26. The aerosol-generating article of any one of Ex1 to Ex25, wherein the resistance to draw of the aerosol-generating article when the at least one permeability control element is fluid permeable is lower than about 50 mm $H_2O$, more preferably lower than about 40 mm $H_2O$, even more preferably lower than about 30 mm $H_2O$, even more preferably lower than about 20 mm $H_2O$, most preferably lower than about 10 mm $H_2O$.

Ex27. The aerosol-generating article of any one of Ex1 to Ex26, wherein the flavour substrate comprises a gel composition.

Ex28. The aerosol-generating article of Ex27, wherein the gel composition is configured to be fluid permeable when the temperature of the gel composition is equal to or greater than a permeability transition temperature of the gel composition, wherein the gel composition is configured to be substantially fluid impermeable when the temperature of the gel composition is lower than the permeability transition temperature of the gel composition, and wherein preferably the permeability transition temperature of the gel composition is a phase transition temperature of the gel composition.

Ex29. The aerosol-generating article of Ex28, wherein the permeability transition temperature of the gel composition is between 70 degrees Celsius and 80 degrees Celsius.

Ex30. The aerosol-generating article of any one of Ex27 to Ex29, wherein the gel composition is configured to be fluid permeable at 85 degrees Celsius, and wherein the gel composition is configured to be substantially fluid impermeable at 20 degrees Celsius.

Ex31. The aerosol-generating article any one of Ex27 to Ex30, wherein the gel composition is thermo-reversible.

Ex32. The aerosol-generating article of any one of Ex27 to Ex31, wherein the gel composition comprises nicotine, preferably in about 0.1% to about 4%, more preferably in about 0.1% to 2%.

Ex33. The aerosol-generating article of any one of Ex27 to Ex32, wherein the gel composition comprises a flavouring agent.

Ex34. The aerosol-generating article of Ex33, wherein the flavouring agent comprises one or more of menthol, coffee derivate flavourings containing, caffeine, guarana, taurine and glucuronolactone.

Ex35. The aerosol-generating article of any one of Ex27 to Ex34, wherein the gel composition comprises glycerine, preferably in about 50% to about 75%, more preferably in about 50% to about 65%.

Ex36. The aerosol-generating article of any one of Ex27 to Ex35, wherein the gel composition comprises hydroxypropylmethyl cellulose (HPMC), preferably in about 15% to about 35%, more preferably in about 18% to about 32%, even more preferably in about 20% to about 30%, most preferably in about 21% to about 27%.

Ex37. The aerosol-generating article of any one of Ex27 to Ex36, wherein the gel composition comprises agar, preferably in about 3% to about 10%, more preferably in about 4% to about 7%.

Ex38. The aerosol-generating article of any one of Ex27 to Ex37, wherein the gel composition comprises fibres, preferably in about 0.1% to about 12%, more preferably in about 0.1% to 7%.

Ex39. The aerosol-generating article of any one of Ex27 to Ex38, wherein the gel composition comprises Low Methoxyl (E440i) pectin, preferably in about 0.1% to about 9%, more preferably in about 0.1% to 7%.

Ex40. The aerosol-generating article of any one of Ex27 to Ex39, wherein the gel composition comprises lactic acid, preferably in about 1.7% to about 3.1%, more preferably in about 2.1% to about 2.9%.

Ex41. The aerosol-generating article of any one of Ex27 to Ex40, wherein the gel composition comprises calactate, preferably in about 0.1% to about 7%, more preferably in about 0.1% to about 3%.

Ex42. The aerosol-generating article of any one of Ex27 to Ex41, wherein the gel composition comprises a cannabinoid compound.

Ex43. The aerosol-generating article of any one of Ex27 to Ex42, wherein the gel composition is uniformly distributed in the flavour substrate.

Ex44. The aerosol-generating article of any one of Ex27 to Ex42, wherein the gel composition is distributed in a variable manner in the flavour substrate.

Ex45. The aerosol-generating article of any one of Ex27 to Ex44, wherein the gel composition has a viscosity of about 1,000,000 to about 1 Pascal per second, preferably 100,000 to 10 Pascal per second, preferably 10,000 to 1,000 Pascal per second, preferably 1,000 to 100 Pascal per second, preferably 500 to 200 Pascal per second.

Ex46. The aerosol-generating article of any one of Ex1 to Ex26, wherein the flavour substrate comprises a flavour material.

Ex47. The aerosol-generating article of Ex46, wherein the flavour material is configured to be fluid permeable when the temperature of the flavour material is equal to or greater than a permeability transition temperature of the flavour material, wherein the flavour material is configured to be substantially fluid impermeable when the temperature of the flavour material is lower than the permeability transition temperature of the flavour material, and wherein preferably the permeability transition temperature of the flavour material is a phase transition temperature of the flavour material.

Ex48. The aerosol-generating article of Ex47, wherein the permeability transition temperature of the flavour material is between 70 degrees Celsius and 80 degrees Celsius.

Ex49. The aerosol-generating article of any one of Ex46 to Ex48, wherein the flavour material is configured to be fluid permeable at 85 degrees Celsius, and wherein the flavour material is configured to be substantially fluid impermeable at 20 degrees Celsius.

Ex50. The aerosol-generating article any one of Ex46 to Ex49, wherein the flavour material is thermo-reversible.

Ex51. The aerosol-generating article of any one of Ex46 to Ex50, wherein the flavour material comprises nicotine, preferably in about 0.1% to about 4%, more preferably in about 0.1% to 2%.

Ex52. The aerosol-generating article of any one of Ex46 to Ex51, wherein the flavour material comprises a flavouring agent.

Ex53. The aerosol-generating article of Ex52, wherein the flavouring agent comprises one or more of menthol, coffee derivate flavourings containing, caffeine, guarana, taurine and glucuronolactone.

Ex54. The aerosol-generating article of any one of Ex46 to Ex53, wherein the flavour material comprises glycerine, preferably in about 50% to about 75%, more preferably in about 50% to about 65%.

Ex55. The aerosol-generating article of any one of Ex46 to Ex54, wherein the flavour material comprises hydroxypropylmethyl cellulose (HPMC), preferably in about 15% to about 35%, more preferably in about 18% to about 32%, even more preferably in about 20% to about 30%, most preferably in about 21% to about 27%.

Ex56. The aerosol-generating article of any one of Ex46 to Ex55, wherein the flavour material comprises agar, preferably in about 3% to about 10%, more preferably in about 4% to about 7%.

Ex57. The aerosol-generating article of any one of Ex46 to Ex56, wherein the flavour material comprises fibres, preferably in about 0.1% to about 12%, more preferably in about 0.1% to 7%.

Ex58. The aerosol-generating article of any one of Ex46 to Ex57, wherein the flavour material comprises Low Methoxyl (E440i) pectin, preferably in about 0.1% to about 9%, more preferably in about 0.1% to 7%.

Ex59. The aerosol-generating article of any one of Ex46 to Ex58, wherein the flavour material comprises lactic acid, preferably in about 1.7% to about 3.1%, more preferably in about 2.1% to about 2.9%.

Ex60. The aerosol-generating article of any one of Ex46 to Ex59, wherein the flavour material comprises calactate, preferably in about 0.1% to about 7%, more preferably in about 0.1% to about 3%.

Ex61. The aerosol-generating article of any one of Ex46 to Ex60, wherein the flavour material comprises a cannabinoid compound.

Ex62. The aerosol-generating article of any one of Ex46 to Ex61, wherein the flavour material comprises hydroxypropylmethyl cellulose, carboxymethyl cellulose, a cellulose based strengthening agent or any combination thereof, preferably in the contents, in percent by weight, disclosed above in the specification.

Ex63. The aerosol-generating article of any one of Ex46 to Ex62, wherein the flavour material comprises a cellulose based strengthening agent, and wherein the cellulose based strengthening agent comprises cellulose fibres, microcrystalline cellulose, cellulose powder or any combination thereof, preferably in the contents, in percent by weight, disclosed above in the specification.

Ex64. The aerosol-generating article of any one of Ex1 to Ex63, wherein the resistance to deformation strength of the flavour substrate may be between about 0.5 kgf to about 3 kgf, preferably between about 1.3 kgf to about 2.7 kgf, more preferably between about 1.9 kgf to about 2.5 kgf.

Ex65. The aerosol-generating article of any one of Ex1 to Ex64, wherein the flavour substrate comprises an external layer.

Ex66. The aerosol-generating article of Ex65, wherein the external layer is made of the same material as the remaining part of the flavour substrate.

Ex67. The aerosol-generating article of any one of Ex1 to Ex66, wherein the distance between the upstream end of the aerosol-forming substrate and the downstream end of the flavour substrate is less than about 40 millimetres, preferably less than about 30 millimetres, even more preferably less than 20 millimetres.

Ex68. The aerosol-generating article of anyone of Ex1 to Ex67, further comprising a regulating member disposed on the tubular element and movable relative to the tubular element, such that the regulating member is configured to vary the size of the air inlet.

Ex69. The aerosol-generating article of Ex68, wherein the regulating member and the tubular element are linearly moveable relative to one another.

Ex70. The aerosol-generating article of Ex68, wherein the regulating member and the tubular element are configured to rotate relative to one another.

Ex71. The aerosol-generating article of Ex68, wherein the regulating member and the tubular element are configured rotate and move linearly relative to one another, for example by means of a screw thread.

Ex72. The aerosol-generating article of any one of Ex1 to Ex71, wherein the aerosol-forming substrate comprises a liquid component.

Ex73. The aerosol-generating article of any one of Ex1 to Ex72, wherein the aerosol-forming substrate comprises a solid component.

Ex74. The aerosol-generating article of any one of Ex1 to Ex73, wherein the aerosol-forming substrate comprises plant-based material, preferably homogenised plant-based material.

Ex75. The aerosol-generating article of any one of Ex1 to Ex74, wherein the aerosol-forming substrate comprises non-tobacco material.

Ex76. The aerosol-generating article of Ex74 or Ex.75, wherein the aerosol-forming substrate comprises tobacco material.

Ex77. The aerosol-generating article of Ex76, wherein the aerosol-forming substrate comprises solid homogenised tobacco material.

Ex78. The aerosol-generating article of Ex77, wherein the aerosol-forming substrate comprises at least one gathered sheet of solid homogenised tobacco material.

Ex79. The aerosol-generating article of Ex78, wherein the at least one gathered sheet comprises a textured sheet, a crimped sheet or both.

Ex80. The aerosol-generating article of any one of Ex77 to Ex79, wherein the solid homogenised tobacco material comprises strips of tobacco material.

Ex81. The aerosol-generating article of any one of Ex73 to Ex80 when depending on Ex80, wherein the aerosol-forming substrate has a rod comprising a plurality of elongate tube-like elements.

Ex82. The aerosol-generating article of Ex81 when depending on Ex77, wherein the plurality of elongate tube-like elements comprise solid homogenised tobacco material.

Ex83. The aerosol-generating article of Ex82, wherein at least one elongate tube-like material comprises a rolled strip cut from a sheet or web of solid homogenised tobacco material.

Ex84. The aerosol-generating article of any one of Ex1 to Ex83, wherein the aerosol-forming substrate is a hollow tubular substrate defining an inner cavity.

Ex85. The aerosol-generating article of any one of Ex1 to Ex84, further comprising a layer of thermally conductive material.

Ex86. The aerosol-generating article of any one of Ex1 to Ex85, wherein the aerosol-forming substrate comprises an aerosol-former.

Ex87. An aerosol-generating device comprising a heater, the heater comprising a substrate heating element configured to heat the aerosol-generating article and a downstream heating element disposed downstream of the substrate heating element.

Ex88. The aerosol-generating device of Ex87, wherein the heater comprises at least one resistive heating element.

Ex89. The aerosol-generating device of Ex88, wherein the at least one resistive heating element comprises an electrically insulating substrate and one or more electrically conductive tracks on the electrically insulating substrate.

Ex90. The aerosol-generating device of any one of Ex87 to Ex89, wherein the heater comprises at least one inductive heating arrangement, each inductive arrangement comprising at least one inductor coil and at least one susceptor.

Ex91. The aerosol-generating device of Ex90, wherein the at least one inductor coil is arranged to generate a varying magnetic field on receiving a varying current from a power supply, the varying current being between about 5 kilohertz and about 500 kilohertz.

Ex92. The aerosol-generating device of Ex90, wherein the at least one inductor coil is arranged to generate a varying magnetic field on receiving a varying current from a power supply, the varying current being between about 500 kilohertz and about 5 megahertz.

Ex93. The aerosol-generating device of any one of Ex90 to Ex92, wherein the at least one inductor coil is a flat inductor coil, such as a flat inductor coil wound in a spiral substantially in a plane.

Ex94. The aerosol-generating device of any one of Ex90 to Ex92, wherein the at least one inductor coil is a tubular inductor coil, such as a tubular inductor coil helically wound about a longitudinal axis.

Ex95. The aerosol-generating device of any one of Ex90 to Ex94, wherein the at least one inductor coil is formed from an electrically conductive material.

Ex96. The aerosol-generating device of any one of Ex90 to Ex95, wherein the at least one susceptor is formed from an electrically conductive material.

Ex97. The aerosol-generating device of any one of Ex90 to Ex96, wherein the at least one susceptor comprises a susceptor layer provided on a support body, the support body preferably comprising a thermally insulative material.

Ex98. The aerosol-generating device of any one of Ex90 to Ex97, wherein the heater comprises at least one resistive heating element and at least one inductive heating element.

Ex99. The aerosol-generating device of any one of Ex87 to Ex98, wherein the substrate heating element is a substrate inductive heating arrangement, comprising a substrate inductor coil and a substrate susceptor.

Ex100. The aerosol-generating device of Ex99, wherein the downstream heating element is a downstream inductive heating arrangement, comprising a downstream inductor coil and a downstream susceptor.

Ex101. The aerosol-generating device of Ex99, wherein the downstream heating element is a resistive heating element.

Ex102. The aerosol-generating device of any one of Ex87 to Ex98, wherein the substrate heating element is a resistive heating element.

Ex103. The aerosol-generating device of Ex102, wherein the downstream heating element is a resistive heating element.

Ex104. The aerosol-generating device of Ex102, wherein the downstream heating element is a downstream inductive heating arrangement, comprising a downstream inductor coil and a downstream susceptor.

Ex105. The aerosol-generating device of any one of Ex87 to Ex98, wherein the downstream heating element is a downstream inductive heating arrangement, comprising a downstream inductor coil and a downstream susceptor.

Ex106. The aerosol-generating device of Ex105, wherein the substrate heating element is a substrate inductive heating arrangement, comprising a substrate inductor coil and a substrate susceptor.

Ex107. The aerosol-generating device of Ex105, wherein the substrate heating element is a resistive heating element.

Ex108. The aerosol-generating device of any one of Ex87 to Ex98, wherein the downstream heating element is a resistive heating element.

Ex109. The aerosol-generating device of Ex108, wherein the substrate heating element is a substrate inductive heating arrangement, comprising a substrate inductor coil and a substrate susceptor.

Ex110. The aerosol-generating device of Ex108, wherein the substrate heating element is a resistive heating element.

Ex111. The aerosol-generating device of any one of Ex87 to Ex110, wherein the heater comprises an internal heating element.

Ex112. The aerosol-generating device of any one of Ex87 to Ex111, wherein the heater comprises an external heating element.

Ex113. The aerosol-generating device of any one of Ex111 or Ex112, wherein the downstream heating element and the substrate heating element are internal heating elements.

Ex114. The aerosol-generating device of Ex111 or Ex112, wherein the downstream heating element and the substrate heating element are external heating elements.

Ex115. The aerosol-generating device of Ex111 or Ex112, wherein the downstream heating element is an internal heating element and the substrate heating element is an external heating element.

Ex116. The aerosol-generating device of any one of Ex111 or Ex112, wherein the downstream heating element is an external heating element and the substrate heating element is an internal heating element.

Ex117. The aerosol-generating device of any one of Ex87 to Ex116, further comprising a power supply.

Ex118. The aerosol-generating device of Ex117, wherein the power supply is electrically connected to the heater.

Ex119. The aerosol-generating device of any one of Ex87 to Ex118, further comprising a cavity for receiving the aerosol-generating article.

Ex120. The aerosol-generating device of any one of Ex87 to Ex119, further comprising a device housing.

Ex121. The aerosol-generating device of Ex119 and Ex120, wherein the device housing defines at least partially the cavity for receiving the aerosol-generating article.

Ex122. The aerosol-generating device of any one of Ex87 to Ex121, further comprising at least one device air inlet.

Ex123. The aerosol-generating device of Ex122 when depending on Ex120, wherein the device housing comprises the at least one device air inlet.

Ex124. The aerosol-generating device of Ex122 or Ex123, wherein the at least one device air inlet comprises a substrate device air inlet.

Ex125. The aerosol-generating device of any one of Ex122 to Ex124, wherein the at least one device air inlet comprises a downstream device air inlet.

Ex126. The aerosol-generating article of any one of Ex87 to Ex125, further comprising a controller.

Ex127. The aerosol-generating article of any one of Ex87 to Ex126, further comprising a sensor configured detect airflow indicative of a user taking a puff.

Ex128. The aerosol-generating article of any one of Ex87 to Ex127, further comprising at least one electrical connector.

Ex129. The aerosol-generating article of Ex128, wherein the at least one electrical connector comprises an external plug or socket, such as a USB plug or a USB socket.

Ex130. An aerosol-generating system comprising the aerosol-generating article of any one of Ex1 to Ex86 and the aerosol-generating device of any one of Ex87 to Ex129.

These and other features and advantages of the invention will become more evident in the light of the following detailed description of preferred embodiments, given only by way of illustrative and non-limiting example, in reference to the attached figures.

Figure 5:
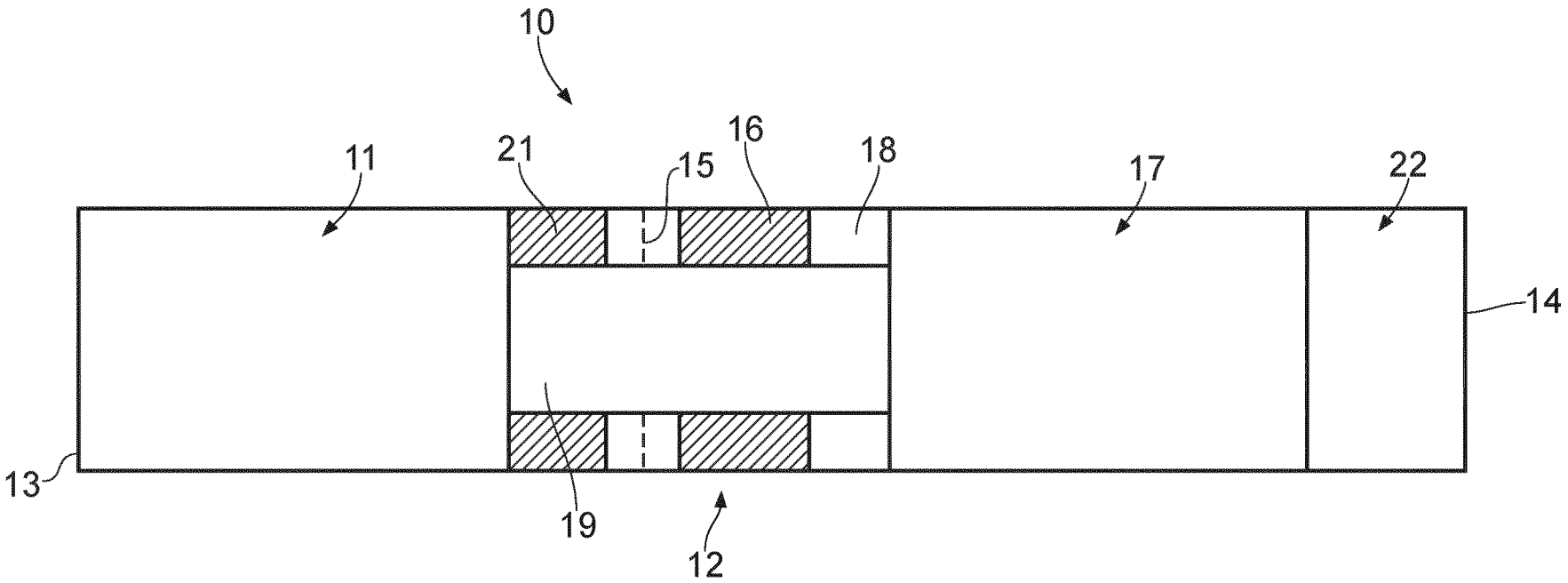

In FIG. 5, a longitudinal section of an aerosol-generating article is shown, wherein a flavour substrate is the only permeability control element downstream of an air inlet within an outer airflow channel.

Figure 6:
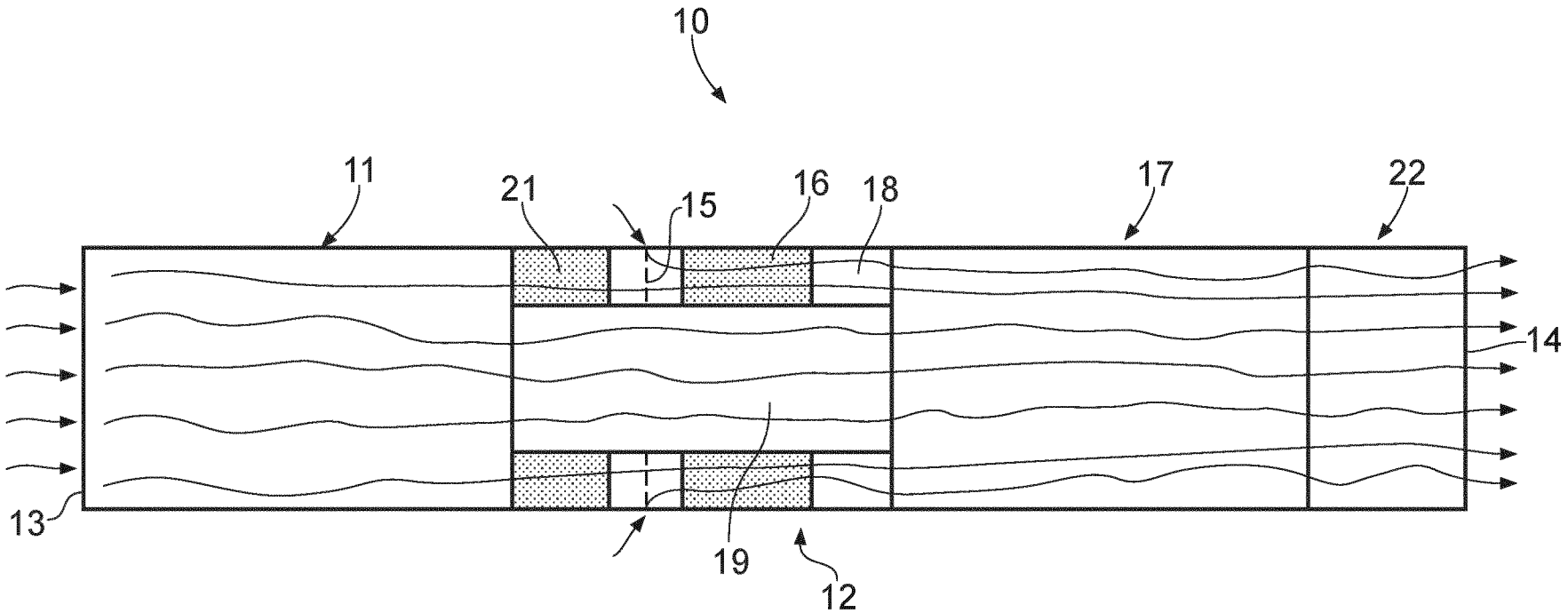

FIG. 6 depicts the aerosol-generating article of FIG. 5 at an instant when an aerosol-forming substrate and the flavour substrate are heated to release aerosol, and a spanning element and the flavour substrate are fluid permeable.

Figure 7:
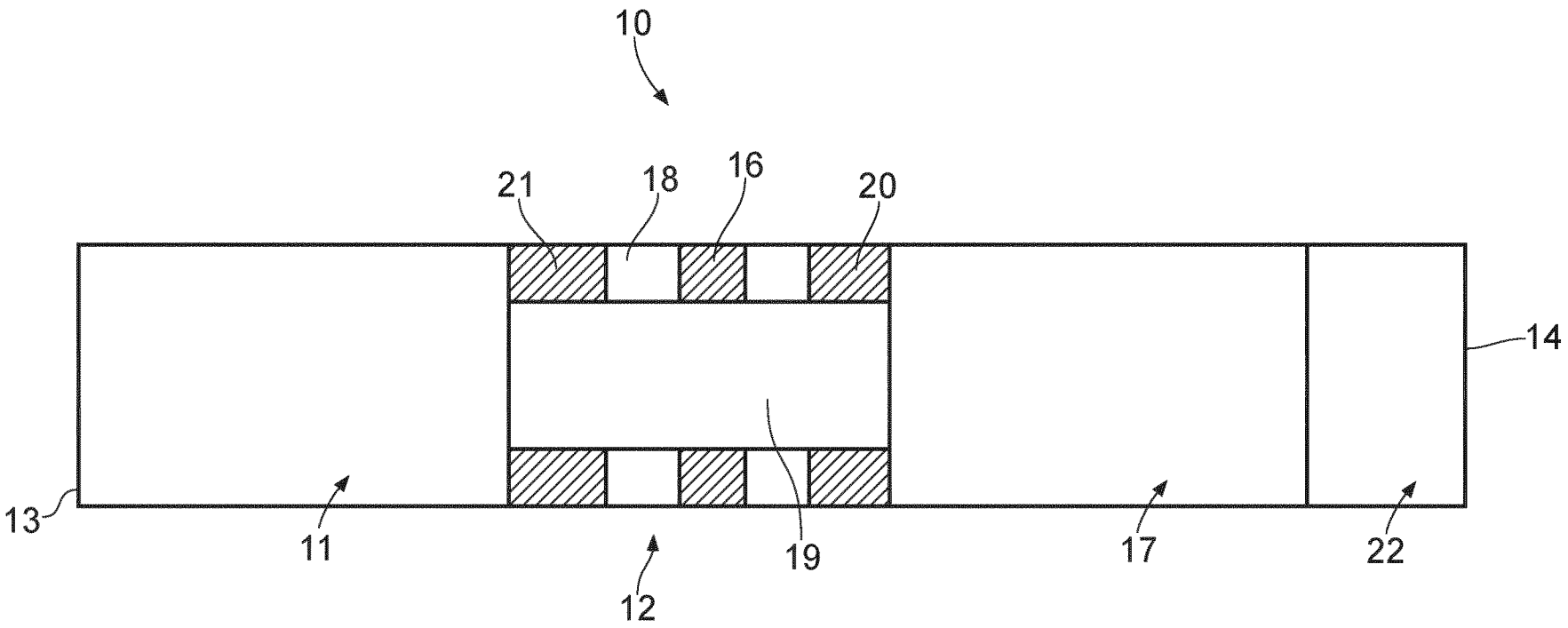

FIG. 7 represents a longitudinal section of an aerosol-generating article in which an outer airflow channel does not comprise an air inlet.

Figure 8:
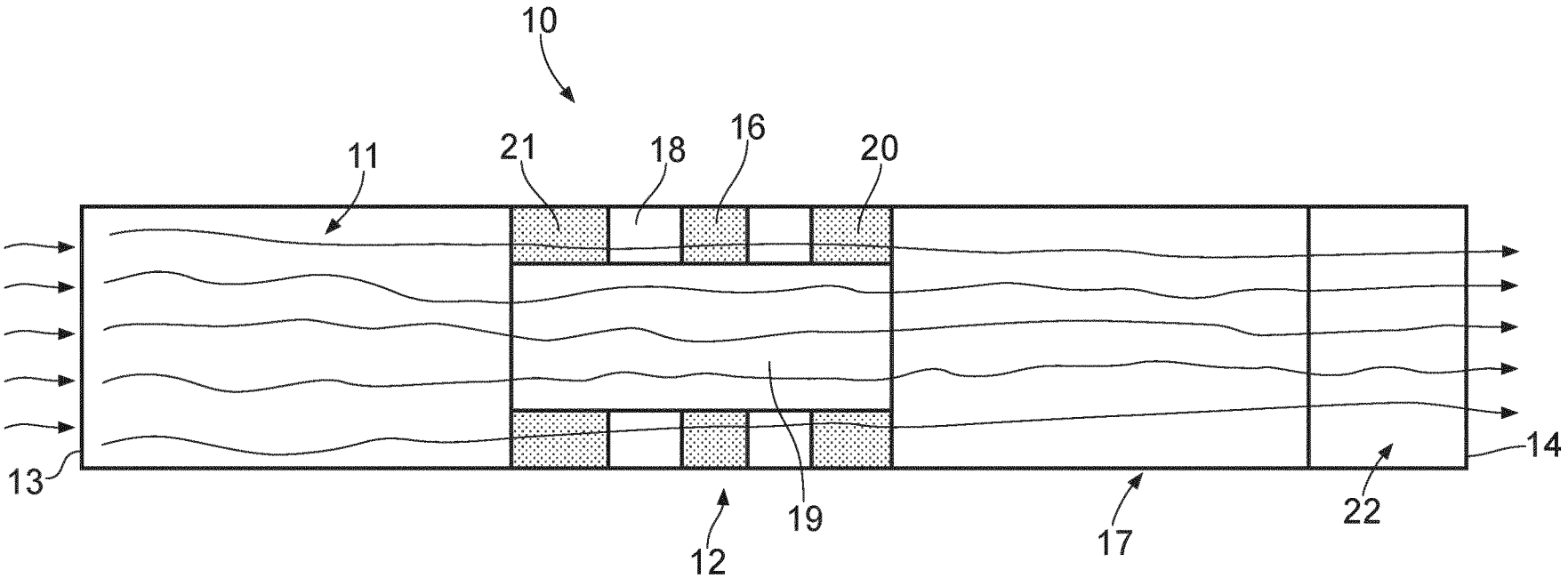

FIG. 8 depicts the aerosol-generating article of FIG. 7 at an instant when an aerosol-forming substrate and a flavour substrate are heated to release aerosol, and a spanning element, the flavour substrate and a permeability control element are fluid permeable.

Figure 9:
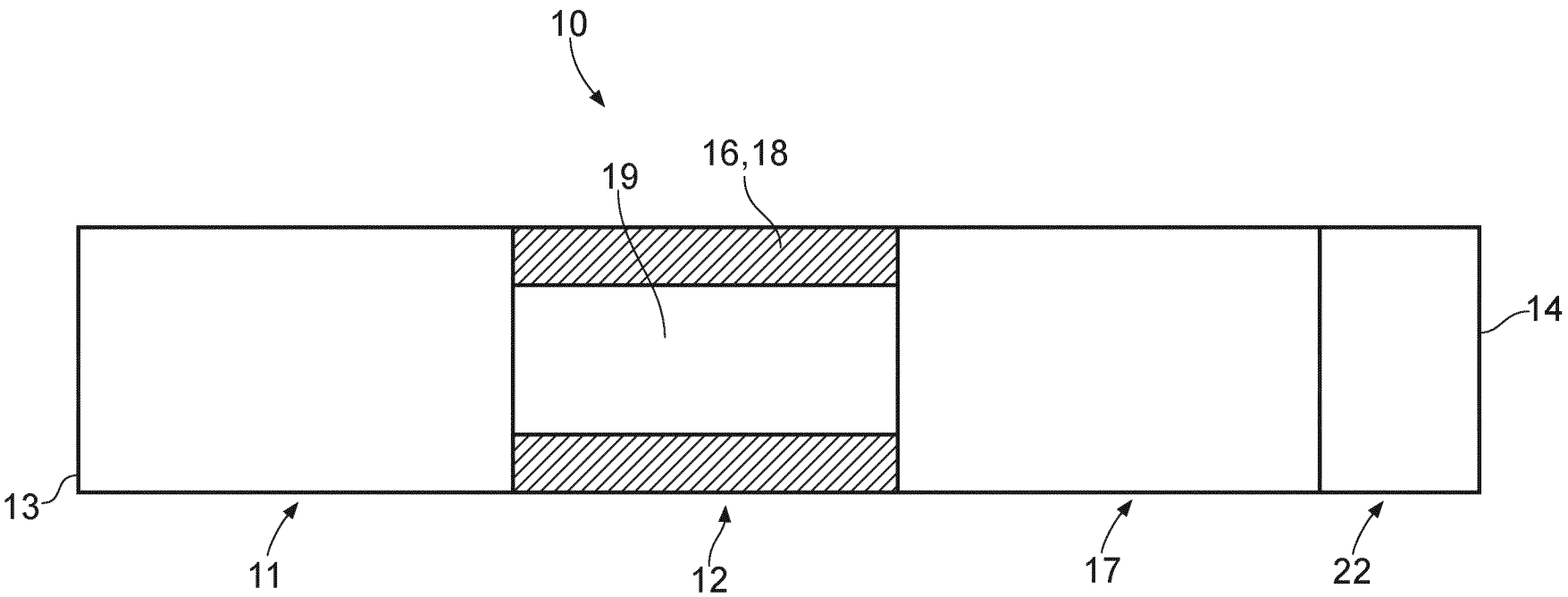

FIG. 9 shows a longitudinal section of an aerosol-generating article in which a flavour substrate occupies the entire length of an outer airflow channel.

Figure 10:
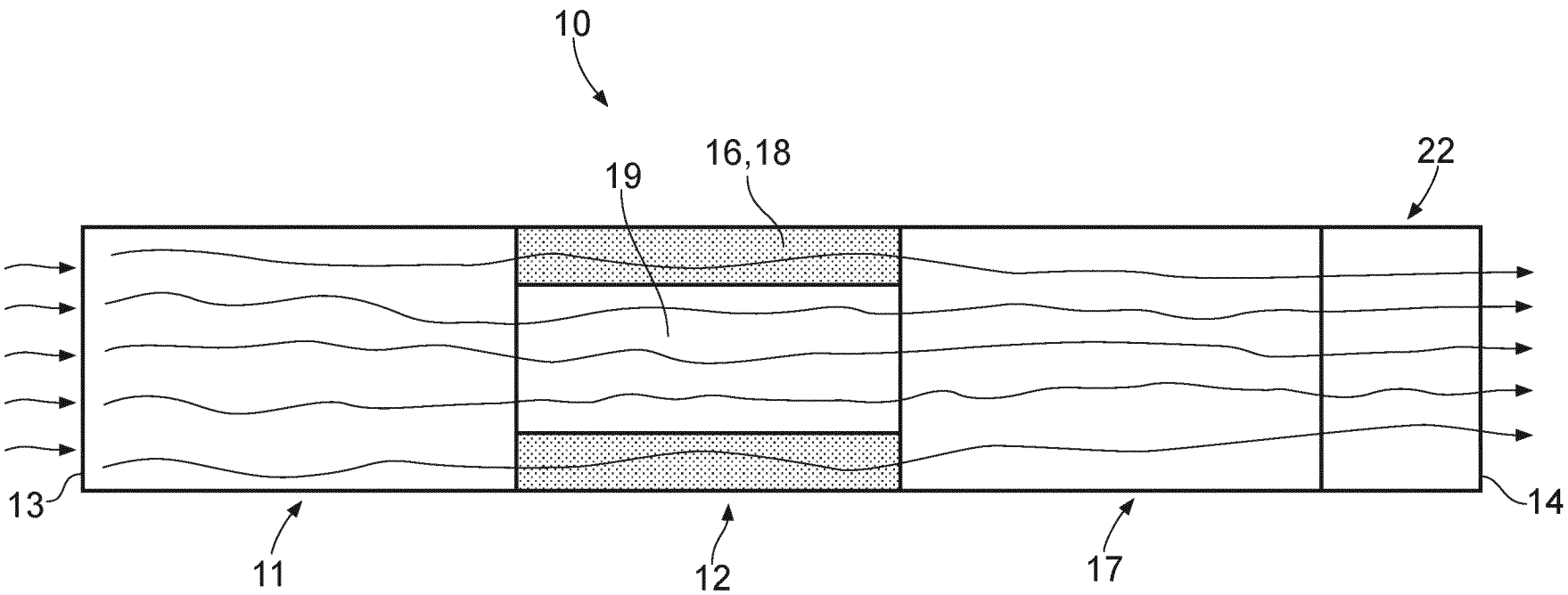

FIG. 10 depicts the aerosol-generating article of FIG. 9 at an instant when an aerosol-forming substrate and the flavour substrate are heated to release aerosol, and the flavour substrate is fluid permeable.

Figure 11:
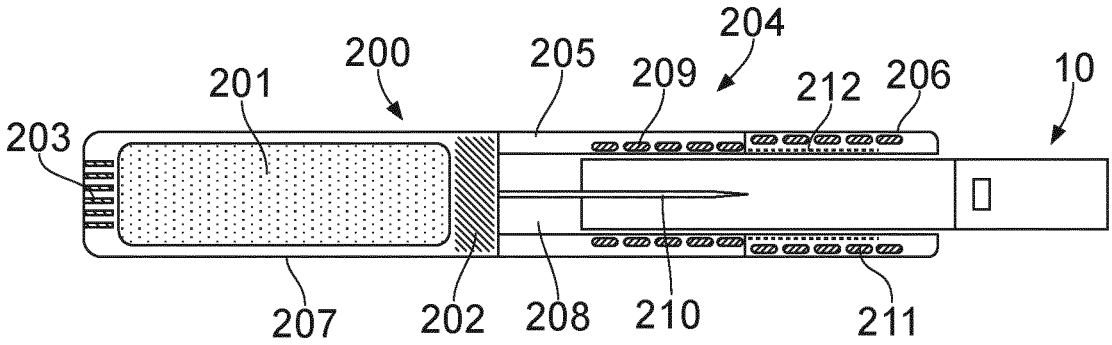

FIG. 11 shows a longitudinal section of an aerosol-generating system comprising an aerosol-generating article and an aerosol-generating device.

Figure 12:
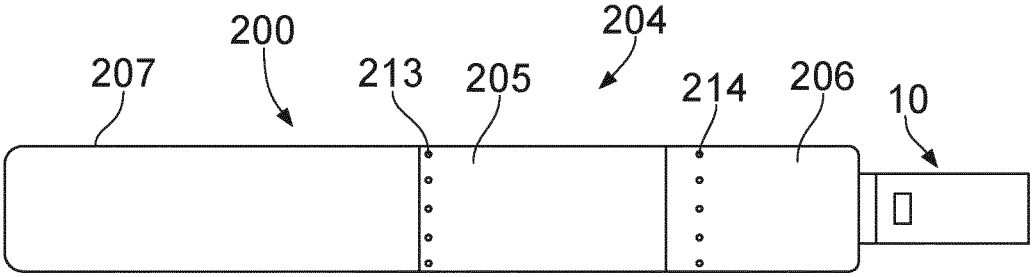

FIG. 12 represents a housing of the aerosol-generating device of FIG. 11 receiving an aerosol-generating article.

Figure 13:
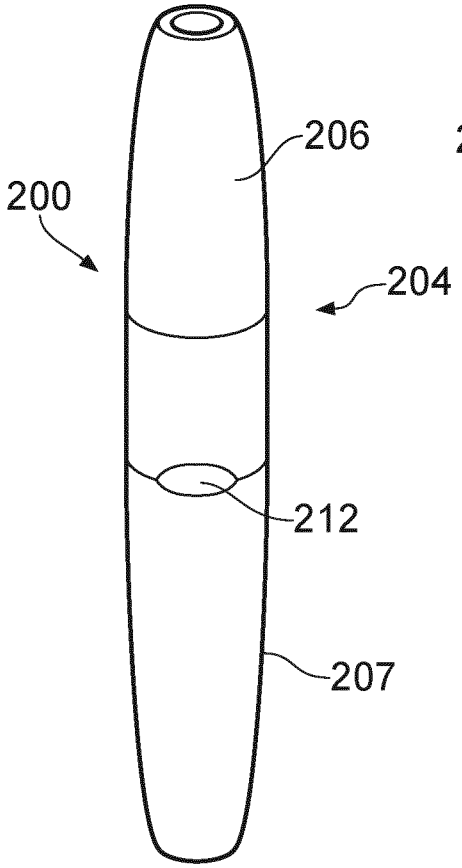

FIG. 13 shows a perspective view of the aerosol-generating device of FIGS. 11 and 12.

Figure 14:
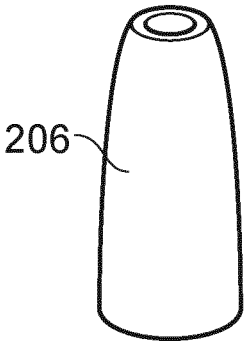

FIG. 14 illustrates a perspective view of a downstream inductive heating arrangement.

Figure 1:
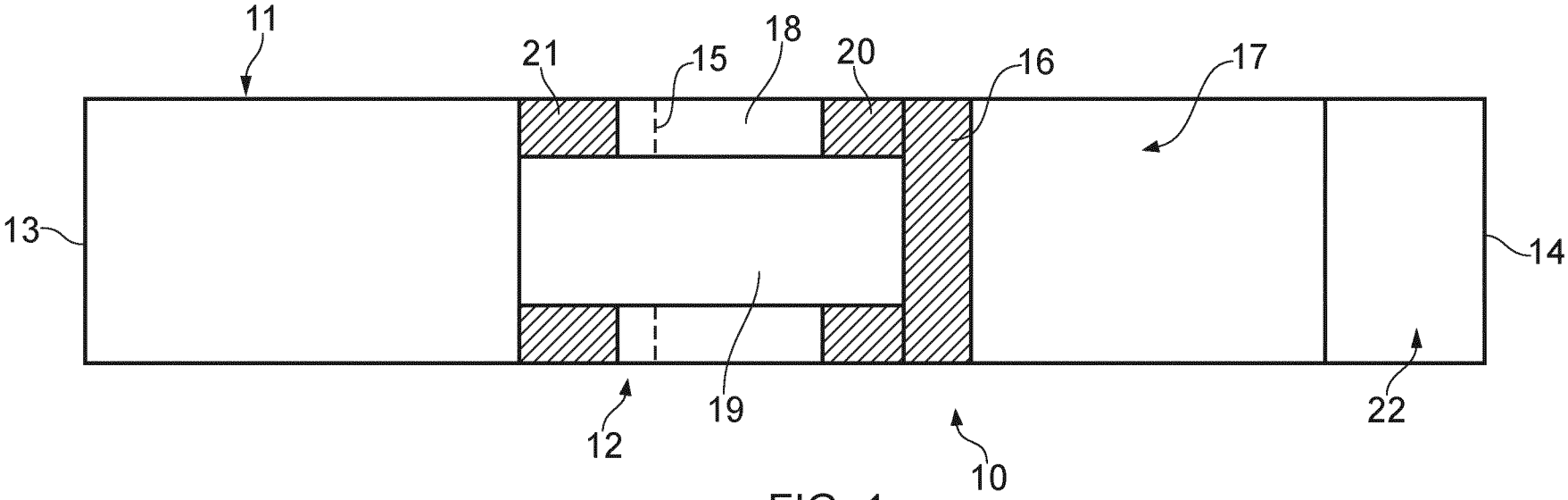
FIG. 1 shows a longitudinal section of an aerosol-generating article in which a tubular element comprises an inner airflow channel and an outer airflow channel.
Figure 15:
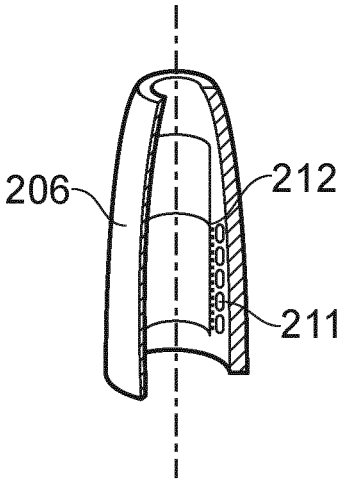

FIG. 15 is an exploded view of the downstream inductive heating arrangement of FIG. 1.

FIG. 1 depicts a longitudinal section of an aerosol-generating article 10 having an upstream end 13 and a downstream end 14, the aerosol-generating article 10 defining a longitudinal direction between the upstream end 13 and the downstream end 14. The article 10 comprises an aerosol-forming substrate 11. In the embodiment of FIG. 1, a tubular element 12 is disposed immediately downstream of the aerosol-forming substrate 11 and extends along the longitudinal direction. The tubular element 12 comprises an outer airflow channel 18 and an inner airflow channel 19. The tubular element 12 comprises an air inlet 15 whereby outside air may be drawn into the outer airflow channel 18. The tubular element 12 defines at least one airflow channel establishing an uninterrupted fluid communication between an upstream end 13 of the tubular element 12 and a downstream end 14 of the tubular element 12.

In the embodiment of FIG. 1, a flavour substrate 16 is disposed immediately downstream of the tubular element 12 in the longitudinal direction. In this embodiment, the flavour substrate 16 comprises a gel composition. However, other flavour materials different from a gel composition may be used in addition or alternatively to the gel composition.

The provision of the flavour substrate 16 downstream of the air inlet 15 comprised in the outer airflow channel 18 allows for a regulation in the amount of airflow the flavour substrate 16 is provided with. The gel composition helps generate a uniform substrate upon heating of the flavour substrate 16, which can give rise to a highly consistent aerosol to be entrained with the substrate aerosol generated by the aerosol-forming substrate 11 disposed upstream of the flavour substrate 16.

Figure 2:
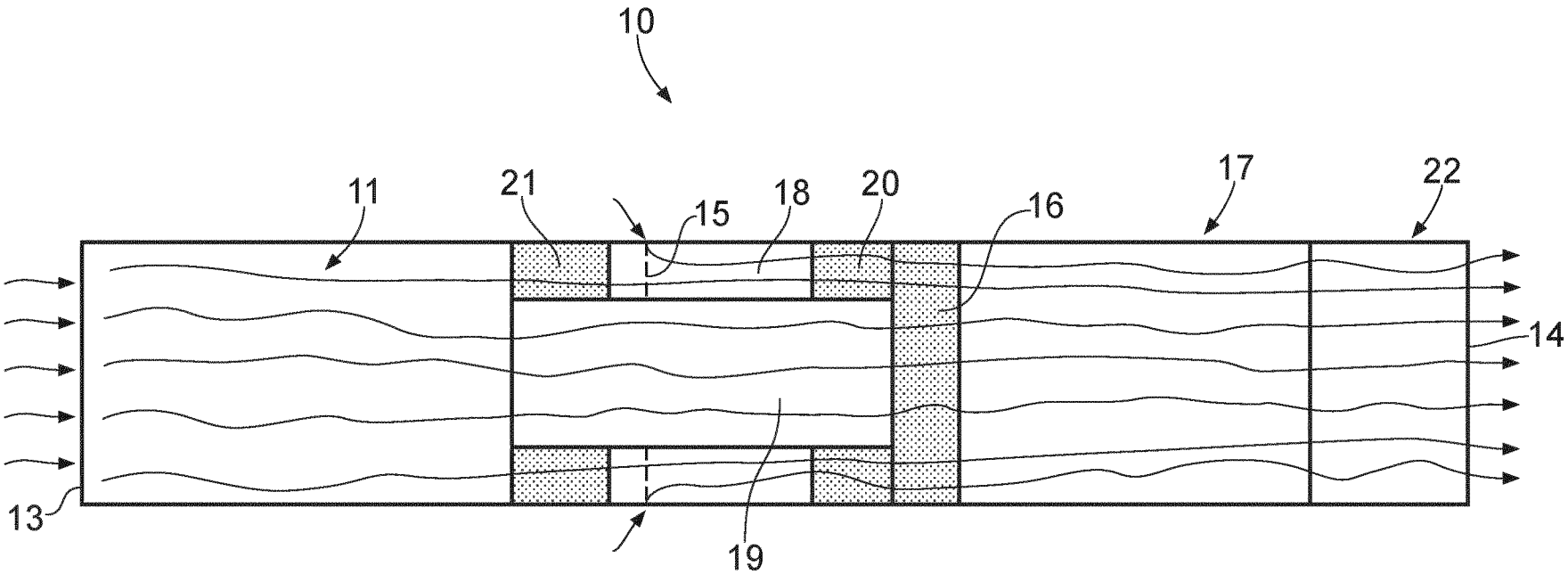
FIG. 2 illustrates the aerosol-generating article of FIG. 1 at an instant when an aerosol-forming substrate and a flavour substrate are heated to release aerosol, and a spanning element, the flavour substrate and a permeability control element are fluid permeable.

In the embodiment of FIG. 1, a permeability control element 20 is disposed within the outer airflow channel 18. The permeability control element 20 is configured to be fluid permeable when the temperature of the permeability control element is equal to or greater than a permeability transition temperature of the permeability control element 20, for instance when the temperature of the permeability control element 20 is 85 degrees Celsius. Likewise, the permeability control element 20 is configured to be substantially fluid impermeable when the temperature of the permeability control element is lower than the permeability transition temperature of the permeability control element, for instance when the temperature of the permeability control element is 20 degrees Celsius. Therefore, the permeability control element 20 may prevent a fluid from flowing along the outer airflow channel 18 downstream of the permeability control element 20 when its temperature is below its permeability transition temperature (as represented in FIG. 1), and to allow a fluid to flow along the outer airflow channel 18 downstream of the permeability control element 20 when its temperature is equal to or greater than its permeability transition temperature (as represented in FIG. 2). This may lead to a change in several properties of the aerosol-generating article 10. Heating the permeability control element 20 to its permeability transition temperature may lead to an increase in the amount of airflow that can flow towards the downstream end 14 of the aerosol-generating article 10 and a reduction in the resistance to draw of the aerosol-generating article 10, since airflow is enabled to flow along the outer airflow channel 18. Likewise, the permeability control element 20 may be advantageously used to regulate the amount of airflow the flavour substrate 16 is provided with.

It is noted that, in FIGS. 1 to 10, a permeability control element marked with dashed lines denotes that the permeability control element is substantially fluid impermeable, whilst a permeability control element marked with dots denotes that the permeability control element is fluid permeable.

In the embodiment of FIG. 1, a spanning element 21 is provided in the outer airflow channel 18 to impede or regulate the flow of substrate aerosol into the outer airflow channel 18. The spanning element 21 may be a permeability control element. When the spanning element 21 is a permeability control element, substrate aerosol may flow into the outer airflow channel 18 upon heating of the aerosol-forming substrate 11 if the temperature of spanning element 21 is equal to or greater than the permeability transition temperature of the spanning element 21, for example at 85 degrees Celsius. Likewise, substrate aerosol may be prevented from flowing into the outer airflow channel 18 upon heating of the aerosol-forming substrate 11 if the temperature of spanning element 21 is lower than the permeability transition temperature of the spanning element 21, for example at 20 degrees Celsius.

In this embodiment, the permeability control element 20 and the spanning element 21 comprise a gel composition. However, in alternative embodiments, the permeability control element 20 and the spanning element 21 comprise other suitable materials to achieve the desired changes of permeability as a function of the temperature of the material.

The gel composition of a permeability control element 20, a spanning element 21, and/or a flavour material of a flavour substrate 16 may have a composition comprising: glycerin in 50 to 75 percent by weight, preferably in 50 to 65 percent by weight; hydroxypropylmethyl cellulose (HPMC) in 15 to 35 percent by weight, preferably 20 to 30 percent by weight; agar in 3 to 10 percent by weight, preferably in 4 to 7 percent by weight; fibers in 0 to 12 percent by weight, preferably in 0 to 7 percent by weight; low methoxyl (LM) (E440i) pectin in 0 to 9 percent by weight, preferably in 0 to 7 percent by weight; lactic acid in 1.7 to 3.1 percent by weight, preferably in 2.1 to 2.9 percent by weight; Ca-lactate in 0 (zero) to 7 percent by weight, preferably in 0 (zero) to 3 percent by weight; and nicotine, nicotine and a flavouring agent, or a flavouring agent, in the amount of 0 to 4 percent by weight, preferably 0 to 2 percent by weight, The flavouring agent can be one or more of menthol extract, vanilla extract, and coffee derivate flavourings. Coffee derivative flavourings contain one or more of caffeine; guarana; taurine; and glucuronolactone. When a flavouring agent is present in the gel composition it is preferably present in 0.2 to 4 percent by weight, more preferably 0.4 to 2 percent by weight.

Examples of the compositions of the gel composition, which may be used in any of the permeability control elements, flavour substrates or spanning elements described herein, are shown in Table 1 below. Table 1 shows the percent by weight of each component of the gel composition:

| | Composition A | | Composition B | |
|---|---|---|---|---|
| | Non-Flavoured | Flavoured | Non-Flavoured | Flavoured |
| Glycerin | 52 | 53 | 61 | 60 |
| Hydroxypropylmethyl cellulose | 21.5 | 21 | 21 | 22 |
| Nicotine | 1.5 | 1.1 | 1.8 | 1.8 |
| Agar | 7.6 | 8 | 3 | 2.4 |
| Fibers (cellulose, length 8 to 15 μm) | 9 | 6.8 | 7.2 | 5.3 |
| Low methoxyl pectin (E440i) | 4 | 5 | 3 | 4 |
| Lactic acid | 2.3 | 2.1 | 3 | 2.8 |
| Ca-lactate | 2.1 | 1 | 0 | 0 |
| Menthol extract (FDA 21CFR182.20), min. 55% Menthol ($C_{10}H_{20}O$) | 0 | 2 | 0 | 0 |
| Vanilla extract (FDA 21CFR169.175), min. 20% Vanillin($C_8H_8O_3$) | 0 | 0 | 0 | 1.7 |

The gel compositions as listed above can provide a predictable composition form upon storage or transit from manufacture to the consumer. The gel compositions may substantially maintain their shape. The gel compositions maintain their state at room temperature (about 21 degrees Celsius). The gel compositions are configured to be in solid state within a range of temperatures that covers standard environment temperatures of use of the aerosol-generating article. The suitable range of environment temperatures may be from about minus 20 degrees Celsius to about 70 degrees Celsius. The overall state of the gel compositions may be predominantly solid, or in gel solid state, and fluid impermeable. Above about 70 degrees Celsius the overall state of the composition may be predominantly liquid, and fluid permeable.

The gel compositions as listed above, when in a solid state, may be configured to have sufficient resistance to deformation in order to provide the flavour substrate with the mechanical stability for its handling during manufacturing, transportation and use of the aerosol-generating article. The gel compositions can have a resistance to deformation strength of 0.5 kgf to 3.0 kgf. The resistance to deformation is preferably between 1.3 kgf to 2.7 kgf, more preferably between 1.9 kgf to 2.5 kgf. The mechanical strength of the gel composition can be tuned to the desired range by adjusting the amount of low methoxyl (LM) pectin in the composition. The use of LM pectin for this purpose will depend on the specific composition formulation, it can be used in proportions between 0.1 to 9 percent by weight, preferably between 0.1 and 7 percent by weight, and most preferably between 1 and 3 percent by weight.

The composition of the gel composition may be distributed in a variable manner within the flavour substrate. In alternative embodiments, the composition can have a homogeneous distribution. The flavour substrate can include an external layer that is useful to give the flavour substrate the required shape to be disposed within the aerosol-generating article. The external layer may be a shell. The remaining part of the flavour substrate may be a core. The flavour substrate comprising the core and an external layer is manufactured by first depositing a core comprising the remaining part of the flavour substrate and then depositing a layer on the core to form the external layer. There are several types of applicable manufacturing processes. The core and external layer may be manufactured by extrusion. A tubular core may be produced and the next step may be a process of extrusion where the gel composition is uniformly deposited on the external surface of the tubular core. The external layer can be made of the same gel composition as the remaining part of the flavour substrate. The core and external layer may have the same characteristics. The core and the external layer may have different characteristics. In one example, the core is softer, with a lower mechanical strength, than a harder external layer, the shell, by about 5 to about 20 percent, preferably by about 10 to about 15 percent. Alternatively, or in addition, if the gel composition comprises a flavouring agent, the external layer (shell) may not comprise a flavouring agent.

In the embodiment shown in FIGS. 1 & 2, the permeability control element 20 and the spanning element 21 each comprise non-flavoured composition A or non-flavoured composition B listed above in Table 1.

In the embodiment shown in FIGS. 1 & 2, the flavour material of the flavour substrate 16 comprises flavoured composition A or flavoured composition B listed above in Table 1.

In the embodiments of FIGS. 1 to 10, a filter 17 is disposed immediately downstream of the tubular element 12 in the longitudinal direction, and a mouthpiece 22 is disposed immediately downstream of the filter 17.

The gel composition of the flavour substrate 16 in the embodiment of FIG. 1 may also be configured to become fluid permeable when the temperature of the gel composition is equal to or greater than a permeability transition temperature of the gel composition, as represented with dots in FIG. 1, and to be substantially fluid impermeable when the temperature of the gel composition is lower than the permeability transition temperature of the gel composition, as represented with dashed lines in FIG. 2. Therefore, the flavour substrate 16 may also be a permeability control element. The flavour substrate may therefore have a gel composition as described above for the permeability control element. The gel composition of the embodiment of FIG. 1 may be configured, in other embodiments, to be substantially fluid impermeable at any operating temperature applied to the flavour substrate by an aerosol-generating device. In the latter embodiment, the flavour substrate does not normally extend cross the an entire cross section of the one or more airflow channels, in order to allow for airflow to flow towards the downstream end downstream of the aerosol-generating article. The flavour substrate may be configured to be fluid permeable and to allow a fluid flowing along the airflow channel to flow downstream of the flavour substrate 16 when the temperature of the flavour substrate is equal to or greater than a permeability transition temperature of the flavour substrate, and configured to be substantially fluid impermeable and to prevent a fluid flowing along the airflow channel from flowing downstream of the flavour substrate 16 when the temperature of the flavour substrate is lower than the permeability transition temperature of the flavour substrate, wherein the flavour substrate is a gel composition.

FIG. 2 is a longitudinal section of the aerosol-generating article of FIG. 1 depicting an instant at which the permeability control element 20, the spanning element 21 and the flavour substrate 16 are each at a temperature at which they are fluid permeable, as represented with dots in the figure. Likewise, the aerosol-forming substrate 11 is heated to generate a substrate aerosol which is entrained with outside air entering the aerosol-generating article 10 on its upstream end 13. A substantial percentage of substrate aerosol flows along the inner airflow channel 19 of the tubular element 12. Since the spanning element 21 is fluid permeable in FIG. 2, a percentage of substrate aerosol flows along the outer airflow channel 18. In examples in which the spanning element is permanently fluid impermeable at any operating temperature of the aerosol-generating article, all the substrate aerosol generated upon heating of the aerosol-forming substrate flows along the inner airflow channel.

In FIG. 2, outside air is drawn into the outer airflow channel 18 through the air inlet 15. The flow of outside air and substrate aerosol reaches the flavour substrate 16, since the permeability control element 20 is fluid permeable at the instant represented in FIG. 2. The flavour substrate 16 is also fluid permeable and, moreover, is heated to form a flavour aerosol. The flavour aerosol is entrained with the flow of outside air and substrate aerosol to form an aerosol inhalable by a user. The entrained aerosol is filtered by the filter 17 and delivered to a user through the mouthpiece 22.

Figure 3:
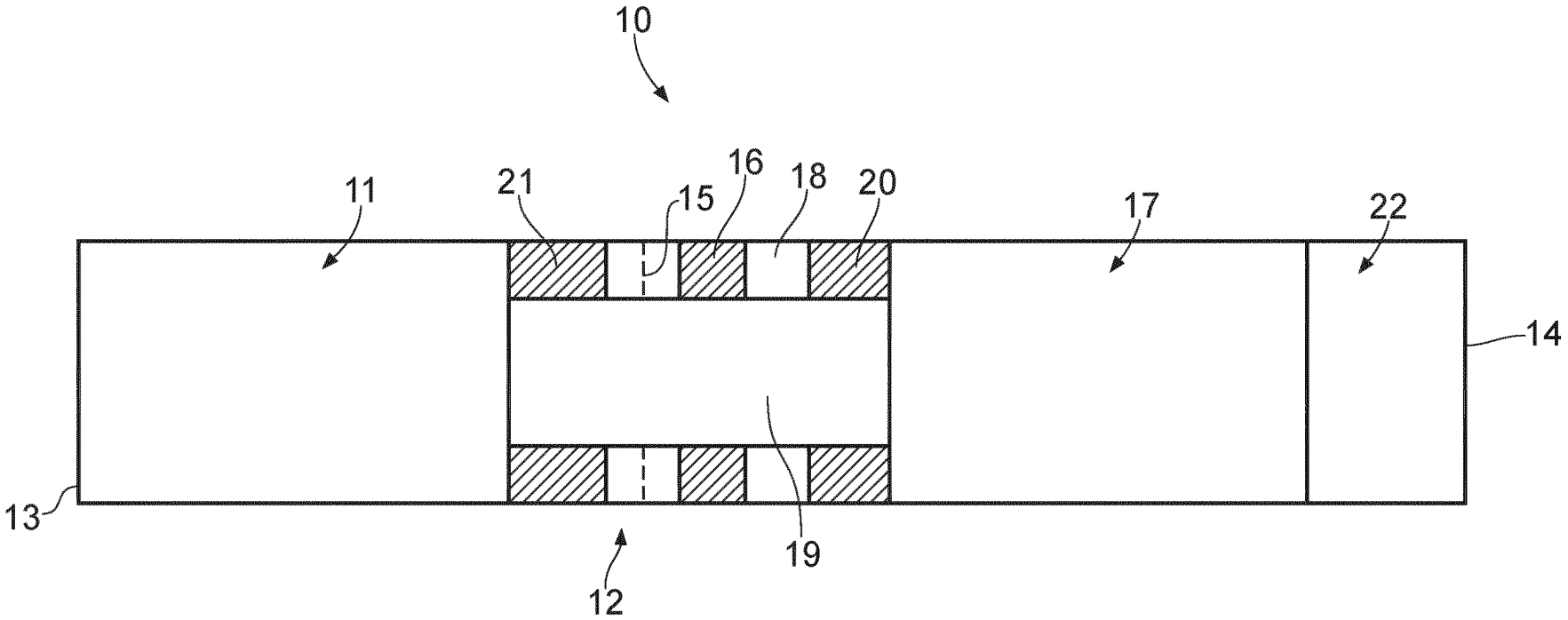
FIG. 3 represents a longitudinal section of an aerosol-generating article in which a flavour substrate is disposed in an outer airflow channel of a tubular element.

FIG. 3 shows a longitudinal section of an aerosol-generating article 10 in which, differently to the aerosol-generating article of FIG. 1, a flavour substrate 16 comprising a gel composition is disposed within an outer airflow channel 18, between an air inlet 15 and a permeability control element 20.

Figure 4:
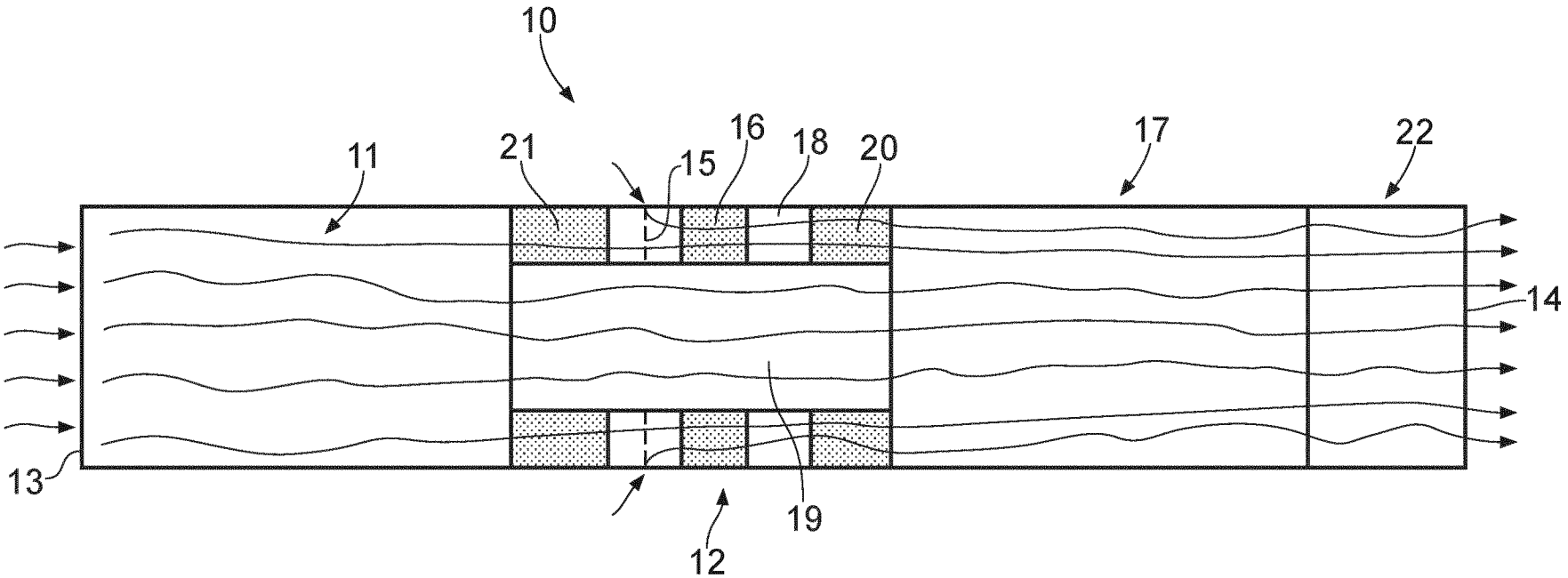
FIG. 4 depicts the aerosol-generating article of FIG. 3 at an instant when an aerosol-forming substrate and the flavour substrate are heated to release aerosol, and a spanning element, the flavour substrate and a permeability control element are fluid permeable.

In this embodiment, the flavour substrate 16 is a permeability control element. Therefore, the flavour substrate 16 prevents airflow from flowing along the outer airflow channel 18 downstream of the flavour substrate 16 when its temperature is below the permeability transition temperature of the gel composition, as represented in FIG. 3. Likewise, the permeability control element 20 prevents airflow from flowing along the outer airflow channel 18 downstream of the permeability control element 20 when its temperatures is below the permeability transition temperature of the permeability control element 20, as is also represented in FIG. 3. The flavour substrate 16 allows airflow to flow along the outer airflow channel 18 downstream of the flavour substrate 16 when its temperature is equal to or greater than the permeability transition temperature of the gel composition, as shown in FIG. 4. The permeability control element 20 allows airflow to flow along the outer airflow channel 18 downstream of the permeability control element 20 when its temperature is equal to or greater than the permeability transition temperature of the permeability control element 20, as is also depicted in FIG. 4.

A spanning element 21 is disposed within the outer airflow channel 18, upstream of the air inlet 15. The spanning element 21 may be a permeability control element. When the spanning element 21 is a permeability control element, substrate aerosol may flow into the outer airflow channel 18 upon heating of the aerosol-forming substrate 11 when the temperature of the spanning element 21 is equal to or greater than the permeability transition temperature of the spanning element 21.

FIG. 4 is a longitudinal section of the aerosol-generating article of FIG. 3 depicting an instant at which the permeability control element 20, the spanning element 21 and the flavour substrate 16 are each at a temperature at which they are fluid permeable, as represented with dots in the figure. Likewise, the aerosol-forming substrate 11 is heated to generate a substrate aerosol which is entrained with outside air entering the aerosol-generating article 10 on its upstream end 13. A substantial percentage of substrate aerosol flows along the inner airflow channel 19 of the tubular element 12. Since the spanning element 21 is fluid permeable in FIG. 4, a percentage of substrate aerosol flows along the outer airflow channel 18. In examples in which the spanning element is permanently fluid impermeable, all the substrate aerosol generated upon heating of the aerosol-forming substrate flows along the inner airflow channel.

In FIG. 4, outside air is drawn into the outer airflow channel 18 through the air inlet 15. The flavour substrate 16 is also fluid permeable and, moreover, is heated to form a flavour aerosol within the outer airflow channel 18. The flavour aerosol is entrained with the flow of outside air and the percentage of substrate aerosol in the outer airflow channel 18. The resulting aerosol reaches the filter 17, since the permeability control element 20 disposed downstream of the flavour substrate 16 is fluid permeable at the instant represented in FIG. 6. The aerosol is then entrained with the percentage of substrate aerosol flowing along the inner airflow channel 19 to form an aerosol inhalable by a user. The aerosol is delivered to a user through the mouthpiece 22.

In the embodiment shown in FIGS. 3 & 4, the permeability control element 20 and the spanning element 21 each comprise non-flavoured composition A or non-flavoured composition B listed above in Table 1.

In the embodiment shown in FIGS. 3 & 4, the flavour material of the flavour substrate 16 comprises flavoured composition A or flavoured composition B listed above in Table 1.

FIG. 5 shows a longitudinal section of an aerosol-generating article 10 in which, differently to the aerosol-generating article of FIG. 3, a flavour substrate 16 comprising a gel composition is the only permeability control element disposed downstream of an air inlet 15 within an outer airflow channel 18. Therefore, the flavour substrate 16 prevents airflow from flowing along the outer airflow channel 18 downstream of the tubular element 12 when its temperature is below the permeability transition temperature of the gel composition, as represented in FIG. 5. Likewise, the flavour substrate 16 allows airflow to flow along the outer airflow channel 18 downstream of the tubular element 12 when its temperature is equal to or greater than the permeability transition temperature of the gel composition, as shown in FIG. 6.

FIG. 6 is a longitudinal section of the aerosol-generating article of FIG. 5 depicting an instant at which the spanning element 21 and the flavour substrate 16 are each at a temperature at which they are fluid permeable, as represented with dots in the figure. Likewise, the aerosol-forming substrate 11 is heated to generate a substrate aerosol which is entrained with outside air entering the aerosol-generating article 10 on its upstream end 13. A substantial percentage of substrate aerosol flows along the inner airflow channel 19 of the tubular element 12. Since the spanning element 21 is fluid permeable in FIG. 6, a percentage of substrate aerosol also flows along the outer airflow channel 18. In examples in which the spanning element is permanently fluid impermeable, all the substrate aerosol generated upon heating of the aerosol-forming substrate flows along the inner airflow channel.

In FIG. 6, outside air is drawn into the outer airflow channel 18 through the air inlet 15. The flavour substrate 16 is fluid permeable at the instant of FIG. 6 and, moreover, is heated to form a flavour aerosol within the outer airflow channel 18. Therefore, flavour aerosol is entrained with the flow of outside air and the percentage of substrate aerosol in the outer airflow channel 18. The resulting aerosol is entrained with the percentage of substrate aerosol flowing along the inner airflow channel 19 to form an aerosol inhalable by a user. The aerosol is filtered by the filter 17 and delivered to a user through the mouthpiece 22.

In the embodiment shown in FIGS. 5 & 6, the spanning element 21 comprises non-flavoured composition A or non-flavoured composition B listed above in Table 1.

In the embodiment shown in FIGS. 5 & 6, the flavour material of the flavour substrate 16 comprises flavoured composition A or flavoured composition B listed above in Table 1.

FIG. 7 shows a longitudinal section of an aerosol-generating article 10 in which, differently to the aerosol-generating articles of the three preceding embodiments, the outer airflow channel 18 comprises no air inlet. In the embodiment of FIG. 7, a spanning element 21 is provided within the outer airflow channel 18 upstream of the flavour substrate 16, and a permeability control element 20 is disposed downstream of the flavour substrate 16. The flavour substrate 16 of this embodiment is a permeability control element. Therefore, the airflow along the outer airflow channel 18 downstream of the flavour substrate 16 and the permeability control element 20 may be prevented or allowed as in the embodiment of FIG. 3, by varying the permeability of the flavour substrate 16 and the permeability control element 20, respectively. The spanning element 21 may be a permeability control element. When the spanning element 21 is a permeability control element, it may also prevent or allow airflow from flowing along the outer airflow channel 18. In particular, substrate aerosol may flow into the outer airflow channel 18 upon heating of the aerosol-forming substrate 11 if the temperature of the spanning element 21 is equal to or greater than the permeability transition temperature of the spanning element 21.

FIG. 8 is a longitudinal section of the aerosol-generating article of FIG. 7 depicting an instant in which the permeability control element 20, the spanning element 21 and the flavour substrate 16 are each at a temperature at which they are fluid permeable, as represented with dots in the figure. Likewise, the aerosol-forming substrate 11 is heated to generate a substrate aerosol which is entrained with outside air entering the aerosol-generating article 10 on its upstream end 13. A substantial percentage of the substrate aerosol flows along the inner airflow channel 19 of the tubular element 12. Since the spanning element 21 is fluid permeable in FIG. 8, a percentage of substrate aerosol also flows along the outer airflow channel 18. In examples in which the spanning element is permanently fluid impermeable, all the substrate aerosol generated upon heating of the aerosol-forming substrate flows along the inner airflow channel.

At the instant of FIG. 8, the flavour substrate 16 is fluid permeable and, moreover, is heated to form a flavour aerosol within the outer airflow channel 18. Therefore, the flavour aerosol is entrained with the percentage of substrate aerosol in the outer airflow channel 18, without being blended with outside air directly drawn into the airflow channel 18. The resulting aerosol is entrained with the percentage of substrate aerosol flowing along the inner airflow channel 19 to form an aerosol inhalable by a user. The aerosol is filtered by the filter 17 and delivered to a user through the mouthpiece 22.

In the embodiment shown in FIGS. 7 & 8, the permeability control element 20 and the spanning element 21 each comprise non-flavoured composition A or non-flavoured composition B listed above in Table 1.

In the embodiment shown in FIGS. 7 & 8, the flavour material of the flavour substrate 16 comprises flavoured composition A or flavoured composition B listed above in Table 1.

FIG. 9 shows a longitudinal section of an aerosol-generating article 10 in which the flavour substrate 16 occupies the entire length of the outer airflow channel 18. Therefore, in this embodiment, the flavour substrate 16 is the only permeability control element. The flavour substrate 16 also plays the role of the spanning element of the previous embodiments. The flavour substrate 16 prevents airflow from flowing into the outer airflow channel 18 and along the outer airflow channel 18 downstream of tubular element 12 when the temperature of the flavour substrate 16 is lower than the permeability transition temperature of the gel composition, as depicted in FIG. 9 with dashed lines. The flavour substrate 16 allows airflow to flow into the outer airflow channel 18 and along the outer airflow channel 18 downstream of the tubular element 12 when heated at temperatures equal to or greater than the permeability transition temperature of the gel composition, as depicted in FIG. 10.

FIG. 10 is a longitudinal section of the aerosol-generating article of FIG. 9 depicting an instant in which the flavour substrate 16 is at a temperature at which they the gel composition is fluid permeable, as represented with dots in the figure. Likewise, the aerosol-forming substrate 11 is heated to generate a substrate aerosol which is entrained with outside air entering the aerosol-generating article 10 on its upstream end 13. A substantial percentage of the substrate aerosol flows along the inner airflow channel 19 of the tubular element 12. Since the flavour substrate 16 is fluid permeable in FIG. 10, a percentage of substrate aerosol also flows along the outer airflow channel 18. In examples in which the spanning element is permanently fluid impermeable, all the substrate aerosol generated upon heating of the aerosol-forming substrate flows along the inner airflow channel.

In FIG. 10, the flavour substrate 16 is heated to form a flavour aerosol within the outer airflow channel 18. Therefore, the flavour aerosol is entrained with the percentage of substrate aerosol in the outer airflow channel 18, without being blended with outside air directly drawn into the airflow channel 18. The resulting aerosol is entrained with the percentage of substrate aerosol flowing along the inner airflow channel 19 to form an aerosol inhalable by a user. The aerosol is filtered by the filter 17 and delivered to a user through the mouthpiece 22.

In the embodiment shown in FIGS. 9 & 10, the flavour material of the flavour substrate 16 comprises flavoured composition A or flavoured composition B listed above in Table 1.

FIG. 11 shows a schematic cross-section of an aerosol-generating system comprising an aerosol-generating device 200 and an aerosol-generating article 10. The aerosol-generating article 10 may be any of the articles of FIGS. 1 to 8.

The aerosol-generating device 200 comprises a substantially cylindrical device housing 207, with a shape and size similar to a conventional cigar.

The aerosol-generating device 200 further comprises a power supply 201, in the form of a rechargeable nickel-cadmium battery, a controller 202 in the form of a printed circuit board including a microprocessor, an electrical connector 203 and a heater 204. The heater 204 comprises a substrate heating element 205, configured to heat the aerosol-forming substrate 11, and a downstream heating element 206 disposed downstream of the substrate heating element 205. The downstream heating element 206 is configured to heat the flavour substrate 16 and, in the corresponding embodiments, the permeability control element 20 and the spanning element 21.

In the embodiment of FIG. 11, the substrate heating element 205 and the downstream heating element 206 are respectively a substrate inductive heating arrangement 205 and a downstream inductive heating arrangement 206, each comprising at least one inductor coil and at least one susceptor. However, other forms of heating elements, such as resistive heating elements, may be used.

The power supply 201, the controller 202 and the inductive heating arrangements 205, 206 are all housed within the device housing 207. The inductive heating arrangements 205, 206 of the aerosol-generating device 200 are arranged at the proximal end of the device 200. The electrical connector 203 is arranged at a distal end of the device housing 207.

As used herein, the term "proximal" refers to a user end, or mouth end of the aerosol-generating device or aerosol-generating article. The proximal end of a component of an aerosol-generating device or an aerosol-generating article is the end of the component closest to the user end, or mouth end of the aerosol-generating device or the aerosol-generating article. As used herein, the term "distal" refers to the end opposite the proximal end.

The controller 202 is configured to control the supply of power from the power supply 201 to the inductive heating arrangements 205, 206. The controller 202 further comprises a DC/AC inverter, including a Class-D power amplifier. The controller 202 is also configured to control recharging of the power supply 201 from the electrical connector 203. The controller 202 further comprises a puff sensor (not shown) configured to sense when a user is drawing on an aerosol-generating article received in a device cavity 208.

The substrate inductive heating arrangement 205 comprises a substrate inductor coil 209 and a substrate susceptor 210. The substrate susceptor 210 is a blade susceptor configured to penetrate into the aerosol-forming substrate 11 to provide internal heating to the aerosol-forming substrate 11. The substrate inductor coil 209 is tubular in the embodiment of FIG. 11 and is disposed concentrically around the portion of the cavity 208 configured to receive the aerosol-forming substrate 11.

The substrate inductor coil 209 is connected to the controller 202 and the power supply 201, and the controller 202 is configured to supply a varying electric current to the substrate inductor coil 209. When the varying electric current is supplied to the substrate inductor coil 209, the substrate inductor coil 209 generates a varying magnetic field, which heats the substrate susceptor 210 by induction.

The downstream inductive heating arrangement 206 comprises a downstream inductor coil 211 and a downstream susceptor 212. The downstream susceptor 212 is a tubular susceptor configured to be disposed concentrically around the section of the aerosol-generating article 10 comprising the flavour substrate 16, in order to provide external heating to the flavour substrate 16. When the aerosol-generating article 10 comprises a permeability control element 20, a spanning element 21 or both, the downstream susceptor 212 is also configured to be disposed concentrically around the section of the aerosol-generating article 10 comprising the permeability control element 20 and the spanning element 21. The downstream inductor coil 211 is tubular in the embodiment of FIG. 11 and is disposed concentrically the downstream susceptor 212.

The downstream inductor coil 211 is connected to the controller 202 and the power supply 201, and the controller 202 is configured to supply a varying electric current to the downstream inductor coil 211. When the varying electric current is supplied to the downstream inductor coil 211, the downstream inductor coil 211 generates a varying magnetic field, which heats the downstream susceptor 212 by induction.

As represented in FIG. 12, the device housing 207 also defines a substrate device air inlet 213 in close proximity to the distal end of the cavity 208 for receiving the aerosol-generating article 10. The substrate device air inlet 213 is configured to enable ambient air to be drawn into the device housing 207 towards the aerosol-forming substrate 11. The device housing 207 also defines a downstream device air inlet 214. The downstream device air inlet 214 is configured to enable ambient air to be drawn into device housing 202 towards the air inlet 15 of the tubular element 12 of the aerosol-generating article 10, in the embodiments in which the tubular element 12 comprises an air inlet 15. For this reason, the downstream device air inlet 214 is configured to substantially match the air inlet 15 of the tubular element 12 when the aerosol-generating article 10 is fully introduced into the device cavity 208.

FIG. 13 illustrates an outside view of the aerosol-generating device 200 of FIGS. 11 and 12. The external surfaces of the substrate inductive heating arrangement 205 and the downstream inductive heating arrangement 206 are shown in FIG. 13. Downstream of the substrate inductive heating arrangement 205, the aerosol-generating device 200 comprises a button 212 configured to switch on and switch off the components of the heater 204.

The downstream inductive heating arrangement 206 is also represented in FIG. 14, separated from the rest of the aerosol-generating device 200 to show that, in this embodiment, the downstream inductive heating arrangement 206 can be removably attached to the rest of the aerosol-generating device 200.

FIG. 15 is an exploded view of the downstream inductive heating arrangement 206 of FIG. 14, depicting the downstream inductor coil 211 and the downstream susceptor 212.

The invention claimed is:

1. An aerosol-generating article having an upstream end and a downstream end, the aerosol-generating article defining a longitudinal direction between the upstream end and the downstream end, the aerosol-generating article comprising:

an aerosol-forming substrate;

a tubular element disposed downstream of the aerosol-forming substrate and extending along the longitudinal direction, the tubular element comprising an inner tube and an outer tube, the outer tube being disposed around the inner tube, wherein an outer airflow channel is longitudinally delimited by the inner tube and the outer tube, wherein an inner airflow channel is longitudinally delimited by the inner tube, and wherein at least the inner airflow channel is configured for substrate aerosol to flow towards the downstream end;

a flavour substrate disposed downstream of the aerosol-forming substrate; and at least one permeability control element comprising a gel composition, wherein the at least one permeability control element is configured to be fluid permeable when a temperature of the at least one permeability control element is equal to or greater than a permeability transition temperature of the permeability control element, wherein the at least one permeability control element is further configured to be substantially fluid impermeable when the temperature of the at least one permeability control element is lower than the permeability transition temperature of the permeability control element, and wherein the at least one permeability control element is disposed within the outer airflow channel and is radially confined between the inner tube and the outer tube, the at least one permeability control element being further configured to prevent a fluid from flowing along the outer airflow channel downstream of the permeability control element when the temperature of the at least one permeability control element is lower than the permeability transition temperature of the permeability control element, and to allow a fluid to flow along the outer airflow channel downstream of the permeability control element when the temperature of the at least one permeability control element is equal to or greater than the permeability transition temperature of the permeability control element.

2. An aerosol-generating article having an upstream end and a downstream end, the aerosol-generating article defining a longitudinal direction between the upstream end and the downstream end, the aerosol-generating article comprising:

an aerosol-forming substrate;

a tubular element disposed downstream of the aerosol-forming substrate and extending along the longitudinal direction, the tubular element comprising an inner tube and an outer tube, the outer tube being disposed around the inner tube, wherein an outer airflow channel is longitudinally delimited by the inner tube and the outer tube, wherein an inner airflow channel is longitudinally delimited by the inner tube, and wherein at least the inner airflow channel is configured for substrate aerosol to flow towards the downstream end;

a flavour substrate disposed downstream of the aerosol-forming substrate; and at least one permeability control element comprising a gel composition, wherein the at least one permeability control element is disposed within the outer airflow channel and is radially confined between the inner tube and the outer tube, the at least one permeability control element being configured to prevent a fluid from flowing along the outer airflow channel downstream of the permeability control element when a temperature of the at least one permeability control element is 20 degrees Celsius and to allow a fluid to flow along the outer airflow channel downstream of the permeability control element when the temperature of the at least one permeability control element is 85 degrees Celsius.

3. The aerosol-generating article according to claim 1, wherein the flavour substrate is disposed within the outer airflow channel.

4. The aerosol-generating article according to claim 3, wherein the flavour substrate is a permeability control element.

5. The aerosol-generating article according to claim 3, wherein a permeability control element is disposed downstream of the flavour substrate.

6. The aerosol-generating article according to claim 1, wherein a spanning element is disposed within the outer airflow channel upstream of the flavour substrate.

7. The aerosol-generating article according to claim 6, wherein the spanning element is a permeability control element.

8. The aerosol-generating article according to claim 4, wherein the flavour substrate extends longitudinally along the entire outer airflow channel.

9. The aerosol-generating article according to claim 1, further comprising an air inlet configured to allow for intake of outside air into the outer airflow channel.

10. The aerosol-generating article according to claim 9, wherein a spanning element is disposed within the outer airflow channel upstream of the flavour substrate, and wherein the air inlet is disposed downstream of the spanning element.

11. The aerosol-generating article according to claim 9, wherein the flavour substrate is disposed downstream of the air inlet.

12. The aerosol-generating article according to claim 1, further comprising a filter disposed downstream of the tubular element.

13. The aerosol-generating article according to claim 1, wherein the permeability transition temperature of the at least one permeability control element is a phase transition temperature of the at least one permeability control element.

14. The aerosol-generating article according to claim 1, wherein the flavour substrate comprises a flavour material.

15. The aerosol-generating article according to claim 1, wherein the flavor material is the gel composition.

16. An aerosol-generating system comprising:

the aerosol-generating article according to claim 1; and an aerosol-generating device comprising a heater, the heater comprising a substrate heating element configured to heat the aerosol-generating article and a downstream heating element disposed downstream of the substrate heating element.

* * * * *